US010466623B2

(12) United States Patent
Matsumoto et al.

(10) Patent No.: US 10,466,623 B2
(45) Date of Patent: Nov. 5, 2019

(54) POWDER CONTAINER, POWDER SUPPLY DEVICE AND IMAGE FORMING APPARATUS

(71) Applicant: Ricoh Company, Ltd., Tokyo (JP)

(72) Inventors: Junichi Matsumoto, Yokohama (JP); Tsukuru Kai, Fujisawa (JP); Hiroshi Hosokawa, Yokohama (JP); Makoto Komatsu, Yokohama (JP); Tadashi Hayakawa, Yokohama (JP); Yuzuru Ozawa, Ashigarakami-gun (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/377,256

(22) Filed: Apr. 8, 2019

(65) Prior Publication Data

US 2019/0235416 A1 Aug. 1, 2019

Related U.S. Application Data

(60) Continuation of application No. 15/962,387, filed on Apr. 25, 2018, now Pat. No. 10,281,843, which is a (Continued)

(30) Foreign Application Priority Data

Dec. 3, 2010 (JP) ..... 2010-270370
Sep. 9, 2011 (JP) ..... 2011-197303

(51) Int. Cl.
*G03B 15/08* (2006.01)
*G03G 15/08* (2006.01)

(52) U.S. Cl.
CPC ..... *G03G 15/0886* (2013.01); *G03G 15/0865* (2013.01); *G03G 15/0872* (2013.01); *G03G 15/0879* (2013.01); *G03G 2215/0132* (2013.01)

(58) Field of Classification Search
CPC ..... G03G 15/0886; G03G 15/0872; G03G 15/0879; G03G 15/0865
See application file for complete search history.

(56) References Cited

U.S. PATENT DOCUMENTS 4,949,123 A 8/1990 Takashima
5,345,297 A 9/1994 Katakabe et al.
(Continued)

FOREIGN PATENT DOCUMENTS

EP 1229402 A2 8/2002
EP 1921512 A2 5/2008
(Continued)

OTHER PUBLICATIONS

International Search Report dated Jan. 17, 2012 in PCT/JP11/78626 Filed Dec. 2, 2011.
(Continued)

*Primary Examiner* — David M. Gray
*Assistant Examiner* — Andrew V Do
(74) *Attorney, Agent, or Firm* — Xsensus LLP

(57) ABSTRACT

Provided is a powder container having a new structure capable of stable discharge and transport of a powder contained in a container by enabling the powder to be reliably discharged to the outside of the package while preventing the powder from spilling and flying out of the container. The powder container has a container body (138) for transporting powder contained therein from a first end side (138*a*) to a second end side (138*b*) thereof by self-rotating; a nozzle receiver (139) having a nozzle receiving hole (insertion section) (139*a*) arranged inside the second end side of the container body and configured to allow a transport nozzle (162) having a powder receiving inlet (170) to be inserted therein, and a supply port 139*b* arranged in at least a part of the nozzle receiver (139) and configured to (Continued)

supply the powder in the container body (138) to the powder receiving inlet (170): and a shutter (140) supported by the nozzle receiver 139 and configured to open and close the nozzle receiving hole (insertion section) 139*a* by sliding in response to insertion of the transport nozzle 162 into the nozzle receiver (139).

19 Claims, 24 Drawing Sheets

Related U.S. Application Data continuation of application No. 15/383,141, filed on Dec. 19, 2016, now Pat. No. 9,983,509, which is a division of application No. 14/881,317, filed on Oct. 13, 2015, now Pat. No. 9,547,258, which is a continuation of application No. 13/991,250, filed as application No. PCT/JP2011/078626 on Dec. 2, 2011, now Pat. No. 9,482,987.

(56) References Cited

U.S. PATENT DOCUMENTS

| | | | |
|---|---|---|---|
| 5,495,323 | A | 2/1996 | Meetze, Jr. |
| 5,576,816 | A | 11/1996 | Staudt et al. |
| 5,890,040 | A | 3/1999 | Matsuoka et al. |
| 5,995,782 | A | 11/1999 | Isobe et al. |
| 6,118,951 | A | 9/2000 | Kato et al. |
| 6,169,864 | B1 | 1/2001 | Baxendell et al. |
| 6,405,011 | B1 | 6/2002 | Wang et al. |
| 6,505,006 | B1 | 1/2003 | Solanki et al. |
| 6,665,505 | B2 | 12/2003 | Meetze, Jr. et al. |
| 6,898,405 | B2 | 5/2005 | Matsumoto et al. |
| 7,065,313 | B2 | 6/2006 | Matsumoto et al. |
| 7,079,788 | B2 | 7/2006 | Ban et al. |
| 7,248,825 | B2 | 7/2007 | Nishitani et al. |
| 7,321,744 | B2 | 1/2008 | Hosokawa et al. |
| 7,480,476 | B2 | 1/2009 | Hosokawa et al. |
| 7,519,317 | B2 | 4/2009 | Hosokawa et al. |
| 7,697,870 | B2 | 4/2010 | Hosokawa et al. |
| 7,835,673 | B2 | 11/2010 | Hosokawa et al. |
| 8,005,406 | B2 | 8/2011 | Hosokawa et al. |
| 8,095,049 | B2 | 1/2012 | Ishiguro et al. |
| 8,195,070 | B2 | 6/2012 | Hosokawa et al. |
| 8,886,095 | B2 | 11/2014 | Komatsu et al. |
| 2001/0021326 | A1 | 9/2001 | Yanagisawa et al. |
| 2002/0106215 | A1 | 8/2002 | Ban et al. |
| 2002/0114646 | A1 | 8/2002 | Sudo et al. |
| 2002/0122676 | A1 | 9/2002 | Yamada et al. |
| 2003/0116923 | A1 | 6/2003 | Meetze et al. |
| 2003/0170049 | A1 | 9/2003 | Itoh et al. |
| 2004/0223790 | A1 | 11/2004 | Hosokawa et al. |
| 2004/0223791 | A1 | 11/2004 | Yamada et al. |
| 2004/0247343 | A1 | 12/2004 | Matsumoto et al. |
| 2005/0180782 | A1 | 8/2005 | Matsumoto et al. |
| 2006/0034642 | A1 | 2/2006 | Taguchi et al. |
| 2006/0228127 | A1 | 10/2006 | Miyabe et al. |
| 2007/0077100 | A1 | 4/2007 | Suzuki et al. |
| 2007/0122205 | A1 | 5/2007 | Taguchi et al. |
| 2007/0147900 | A1 | 6/2007 | Taguchi et al. |
| 2007/0147902 | A1 | 6/2007 | Taguchi et al. |
| 2007/0154244 | A1 | 7/2007 | Taguchi et al. |
| 2007/0160394 | A1 | 7/2007 | Taguchi et al. |
| 2007/0177886 | A1 | 8/2007 | Taguchi et al. |
| 2007/0177905 | A1 | 8/2007 | Hosokawa et al. |
| 2007/0212119 | A1 | 9/2007 | Kurenuma et al. |
| 2008/0003021 | A1 | 1/2008 | Hosokawa et al. |
| 2008/0124133 | A1 | 5/2008 | Yoshizawa et al. |
| 2008/0286013 | A1 | 11/2008 | Hosokawa et al. |
| 2009/0047037 | A1 | 2/2009 | Miyabe et al. |
| 2009/0129813 | A1 | 5/2009 | Nagashima et al. |
| 2009/0175660 | A1 | 7/2009 | Hosokawa et al. |
| 2010/0158556 | A1 | 6/2010 | Miyabe et al. |
| 2010/0189470 | A1 | 7/2010 | Yoshizawa et al. |
| 2010/0278564 | A1 | 11/2010 | Nagashima et al. |
| 2010/0296847 | A1 | 11/2010 | Kurenuma et al. |
| 2011/0002713 | A1 | 1/2011 | Taguchi et al. |
| 2011/0026973 | A1 | 2/2011 | Hosokawa et al. |
| 2011/0044717 | A1 | 2/2011 | Miyabe et al. |
| 2011/0123232 | A1 | 5/2011 | Takashima et al. |
| 2011/0249991 | A1 | 10/2011 | Hosokawa et al. |
| 2012/0033998 | A1 | 2/2012 | Hori et al. |
| 2012/0042504 | A1 | 2/2012 | Fowler |
| 2012/0099887 | A1 | 4/2012 | Shokaku |
| 2012/0134717 | A1 | 5/2012 | Nagashima et al. |
| 2012/0134718 | A1 | 5/2012 | Nagashima et al. |
| 2012/0134719 | A1 | 5/2012 | Nagashima et al. |
| 2012/0134720 | A1 | 5/2012 | Nagashima et al. |
| 2012/0141169 | A1 | 6/2012 | Yamane et al. |
| 2012/0163877 | A1 | 6/2012 | Kikuchi et al. |
| 2012/0177395 | A1 | 7/2012 | Miyabe et al. |
| 2012/0213555 | A1 | 8/2012 | Komatsu et al. |
| 2012/0301188 | A1 | 11/2012 | Yamabe et al. |
| 2013/0136505 | A1 | 5/2013 | Nagashima et al. |
| 2013/0272750 | A1 | 10/2013 | Matsumoto et al. |
| 2013/0336680 | A1 | 12/2013 | Nagashima et al. |
| 2014/0169838 | A1 | 6/2014 | Nagashima et al. |
| 2014/0270859 | A1 | 9/2014 | Hosokawa et al. |

FOREIGN PATENT DOCUMENTS

| | | | |
|---|---|---|---|
| EP | 1927898 | A2 | 6/2008 |
| JP | 61-162071 | A | 7/1986 |
| JP | 63-178271 | A | 7/1988 |
| JP | 01-130159 | A | 9/1989 |
| JP | 04-009061 | U | 1/1992 |
| JP | H4-168459 | A | 6/1992 |
| JP | 04-368965 | A | 12/1992 |
| JP | 05-249825 | A | 9/1993 |
| JP | 05-075767 | U | 10/1993 |
| JP | 06-059572 | A | 3/1994 |
| JP | 07-20705 | A | 1/1995 |
| JP | 07-181788 | A | 7/1995 |
| JP | 07-199632 | A | 8/1995 |
| JP | 07-261492 | A | 10/1995 |
| JP | H8-220857 | A | 8/1996 |
| JP | 09-197819 | A | 7/1997 |
| JP | 09-211977 | A | 8/1997 |
| JP | 10-20642 | A | 1/1998 |
| JP | 10-153911 | A | 6/1998 |
| JP | 10-171230 | A | 6/1998 |
| JP | 10-198147 | A | 7/1998 |
| JP | 10-260575 | A | 9/1998 |
| JP | H10-254229 | A | 9/1998 |
| JP | H10-260574 | A | 9/1998 |
| JP | 2000-187382 | A | 7/2000 |
| JP | 2000-267420 | A | 9/2000 |
| JP | 2001-034053 | A | 2/2001 |
| JP | 2001-083785 | A | 3/2001 |
| JP | 2001-271912 | A | 10/2001 |
| JP | 2001-312130 | A | 11/2001 |
| JP | 2002-031943 | A | 1/2002 |
| JP | 2002-196629 | A | 7/2002 |
| JP | 2002-202656 | A | 7/2002 |
| JP | 2002-244417 | A | 8/2002 |
| JP | 2002-302169 | A | 10/2002 |
| JP | 2002-357946 | A | 12/2002 |
| JP | 3353194 | B2 | 12/2002 |
| JP | 2003-057931 | A | 2/2003 |
| JP | 2003-66703 | A | 3/2003 |
| JP | 2003-066704 | A | 3/2003 |
| JP | 2003-191497 | A | 7/2003 |
| JP | 2003-195616 | A | 7/2003 |
| JP | 2003-233247 | A | 8/2003 |
| JP | 2003-241496 | A | 8/2003 |
| JP | 2004-12687 | A | 1/2004 |
| JP | 2004-280064 | A | 10/2004 |
| JP | 2005-099434 | A | 4/2005 |
| JP | 3665376 | B2 | 6/2005 |
| JP | 2005-193575 | A | 7/2005 |
| JP | 2005-221825 | A | 8/2005 |
| JP | 2005-242185 | A | 9/2005 |

(56) References Cited

FOREIGN PATENT DOCUMENTS

| | | | |
|---|---|---|---|
| JP | 2005-331622 | A | 12/2005 |
| JP | 2006-058698 | A | 3/2006 |
| JP | 2006-72166 | A | 3/2006 |
| JP | 2006-209060 | A | 8/2006 |
| JP | 2006-235641 | A | 9/2006 |
| JP | 2006-293003 | A | 10/2006 |
| JP | 2006-309016 | A | 11/2006 |
| JP | 2007-065271 | A | 3/2007 |
| JP | 2007-065613 | A | 3/2007 |
| JP | 2007-140433 | A | 6/2007 |
| JP | 2007-178969 | A | 7/2007 |
| JP | 2008-298907 | A | 12/2008 |
| JP | 2009-008698 | A | 1/2009 |
| JP | 2009-069417 | A | 4/2009 |
| JP | 2009-116120 | A | 5/2009 |
| JP | 2009-210615 | A | 9/2009 |
| JP | 2009-223351 | A | 10/2009 |
| JP | 4342958 | B2 | 10/2009 |
| JP | 2009-276659 | A | 11/2009 |
| JP | 2010-14763 | A | 1/2010 |
| JP | 2010-020343 | A | 1/2010 |
| JP | 4441581 | B2 | 3/2010 |
| JP | 2011-107606 | A | 6/2011 |
| JP | 2011-150121 | A | 8/2011 |
| JP | 2011-197159 | A | 10/2011 |
| JP | 2011-215473 | A | 10/2011 |
| JP | 4794892 | B2 | 10/2011 |
| JP | 2012-018377 | A | 1/2012 |
| JP | 2012-093460 | A | 5/2012 |
| JP | 4958325 | B2 | 6/2012 |
| JP | 2012-133349 | A | 7/2012 |
| JP | 2012-137740 | A | 7/2012 |
| JP | 2013-113945 | A | 6/2013 |
| RU | 2398257 | C2 | 8/2010 |
| TW | 201011480 | A | 3/2010 |
| WO | 2006/132259 | A1 | 12/2006 |
| WO | 2012/074139 | A1 | 6/2012 |
| WO | 2013/077474 | A1 | 5/2013 |
| WO | 2014/142362 | A1 | 9/2014 |

OTHER PUBLICATIONS

Office Action dated Jul. 7, 2015, in Japanese Patent Application No. 2013-116876.

Extended European Search Report dated Apr. 1, 2015 in Patent Application No. 12851714.1.

International Search Report dated Jan. 8, 2013 in PCT/JP2012/081219 filed Nov. 26, 2012.

International Written Opinion dated Jan. 8, 2013 in PCT/JP2012/081219 filed Nov. 26, 2012.

Office Action dated Apr. 27, 2015 in Russian Patent Application No. 2014106826/28.

Office Action dated Sep. 3, 2013 in Japanese Patent Application No. 2013-034830.

Office Action dated Jan. 15, 2014 in Canadian Application No. 2,795,123.

Japanese Office Action for Japanese Patent Application No. JP 2011-262861 dated Jul. 23, 2013.

Japanese Office Action for Japanese Patent Application No. JP 2011-262861 dated Nov. 5, 2013.

Taiwan Office Action for Taiwan Patent Application No. 10014415 dated Apr. 25, 2014.

Extended European Search Report for European Patent Application No. 11845366.1 dated Jun. 18, 2014.

Russian Decision on to Grant for Russian Application No. 2013130231, dated Jun. 30, 2014, with English Translation.

Australian Office Action dated Jan. 20, 2015 for Australian Patent Application No. 2011337578.

Japanese Office Action dated Apr. 21, 2015 for Japanese Patent Application No. 2011-197303.

Office Action dated Sep. 10, 2013 in Japanese Patent Application No. 2013-110330.

Office Action dated Nov. 26, 2013 in Japanese Patent Application No. 2013-153815.

Office Action dated Apr. 22, 2014 in Japanese Patent Application No. 2013-153815.

International Search Report dated Jun. 17, 2014 in PCT/JP2014/057949 filed Mar. 14, 2014.

European Search Report dated Apr. 1, 2015 in Patent Application No. 13800861.0.

International Search Report dated Aug. 13, 2013 in PCT/JP2013/065901 filed Jun. 3, 2013.

Indian Examination Report dated Feb. 26, 2018 in corresponding Indian Application No. 1714/KOLNP/2013, including English translation (7 pages).

POWDER CONTAINER, POWDER SUPPLY DEVICE AND IMAGE FORMING APPARATUS

CROSS-REFERENCE TO THE RELATED APPLICATIONS

This application is a continuation application of U.S. application Ser. No. 15/962,387, filed Apr. 25, 2018, which is a continuation application of U.S. application Ser. No. 15/383,141, filed Dec. 19, 2016, (now U.S. Pat. No. 9,983,509), which is a divisional application of U.S. application Ser. No. 14/881,317 (now U.S. Pat. No. 9,547,258), filed Oct. 13, 2015, which is a continuation application of U.S. application Ser. No. 13/991,250 (now U.S. Pat. No. 9,482,987), filed Jun. 3, 2013, which is a national stage of PCT/JP11/078626, filed Dec. 2, 2011, and based on and claims the priority benefit of each of Japanese Patent Application Nos. 2010-270370, filed on Dec. 3, 2010 and 2011-197303, filed on Sep. 9, 2011. The disclosures of each of the above are incorporated herein by reference in their entirety.

TECHNICAL FIELD

The present invention relates to a powder container for containing a developer which is a powder to be used in an image forming apparatus such as a printer, a facsimile machine, a copy machine, or a multi-functional machine equipped with multiple functions, and a powder supply device and an image forming apparatus including the powder container.

BACKGROUND ART

In an image forming apparatus in which a developing device using a powdery toner visualizes an electrostatic latent image formed on an image carrier, the toner in the developing device is consumed with formation of images. Thus, conventionally, an image forming apparatus has been known which includes a toner supply device including a toner container as a powder container containing a toner, and configured to supply the developing device with the toner contained in the toner container.

In a toner supply device thus configured, an opening formed at an end of the toner container is closed by a plug member to prevent a toner in the toner container from spilling out during storage or transportation, and the plug member is removed when the toner supply device is mounted to a main body of an image forming apparatus. Such a toner container, and a toner supply device and an image forming apparatus which include the toner container are disclosed in Patent Document 1, for example.

SUMMARY OF INVENTION

Technical Problem

A toner container is replaced with a new one when the toner in the toner container is used up. In the case of a toner container having a plug member, once the plug member is removed, the toner still remaining in the toner container may spill or fly out of the opening during the replacement. In addition, since a toner container is longer in an axis line direction, an ideal and preferable storage condition for the toner container is that the toner container is stored with its axis line placed horizontal. In contrast, if the toner container is stored in a standing state with the opening facing downward, the toner clumps together due to its own weight around the opening. This phenomenon obstructs toner discharge from the toner container set in a device main body and easily causes unstable toner discharge or transport. Hence, there is a need for a new structure.

An object of the present invention is to provide a powder container having a new structure capable of stable discharge and transport of a powder contained in a container by enabling the powder to be reliably discharged to the outside of the package while preventing the powder from spilling and flying out of the container, and also to provide a powder supply device and an image forming apparatus.

Solution to Problem

To accomplish the above object, a powder container configured to contain powder to be used in an image forming apparatus, according to an embodiment of the present invention includes a container body configured to transport powder contained therein from first end side to a second end side thereof by self-rotating, a nozzle receiver having a nozzle receiving hole arranged on the second end side of the container body and configured to allow a transport nozzle having a powder receiving inlet to be inserted therein, and a supply port arranged in at least a part of the nozzle receiver and configured to supply the powder in the container body to the powder receiving inlet, and an shutter supported by the nozzle receiver and configured to open and close the nozzle receiving hole by sliding in response to insertion of the transport nozzle into the nozzle receiver.

Advantageous Effects of Invention

According to the present invention, since a powder container includes: a nozzle receiver having a nozzle receiving hole arranged on the second end side of a container body and configured to allow a transport nozzle having a powder receiving inlet to be inserted therein, and a supply port arranged in at least a part of the nozzle receiver and configured to supply the powder in the container body to the powder receiving inlet; and an shutter supported by the nozzle receiver and configured to open and close the nozzle receiving hole by sliding in response to an insertion of the transport nozzle into the nozzle receiver. The nozzle receiving hole is closed until the transport nozzle is inserted, and any powder accumulated near the supply port is pushed away when the shutter slides. Consequently, a space is secured around the supply port, which enables reliable supply of the powder from the supply port to the powder receiving inlet. Thus, the powder container is capable of reliably discharging the powder contained in the container to the outside of the container while preventing the powder from spilling and flying out from the container.

DESCRIPTION OF EMBODIMENTS

Embodiments of the present invention will be described hereinafter with reference to the drawings. In the embodiments and modifications, constitutional elements such as members or components, which have the same function or shape, are assigned the same symbol as long as they can be distinguished, and any overlapping description thereof will be omitted.

First Embodiment

Figure 2:
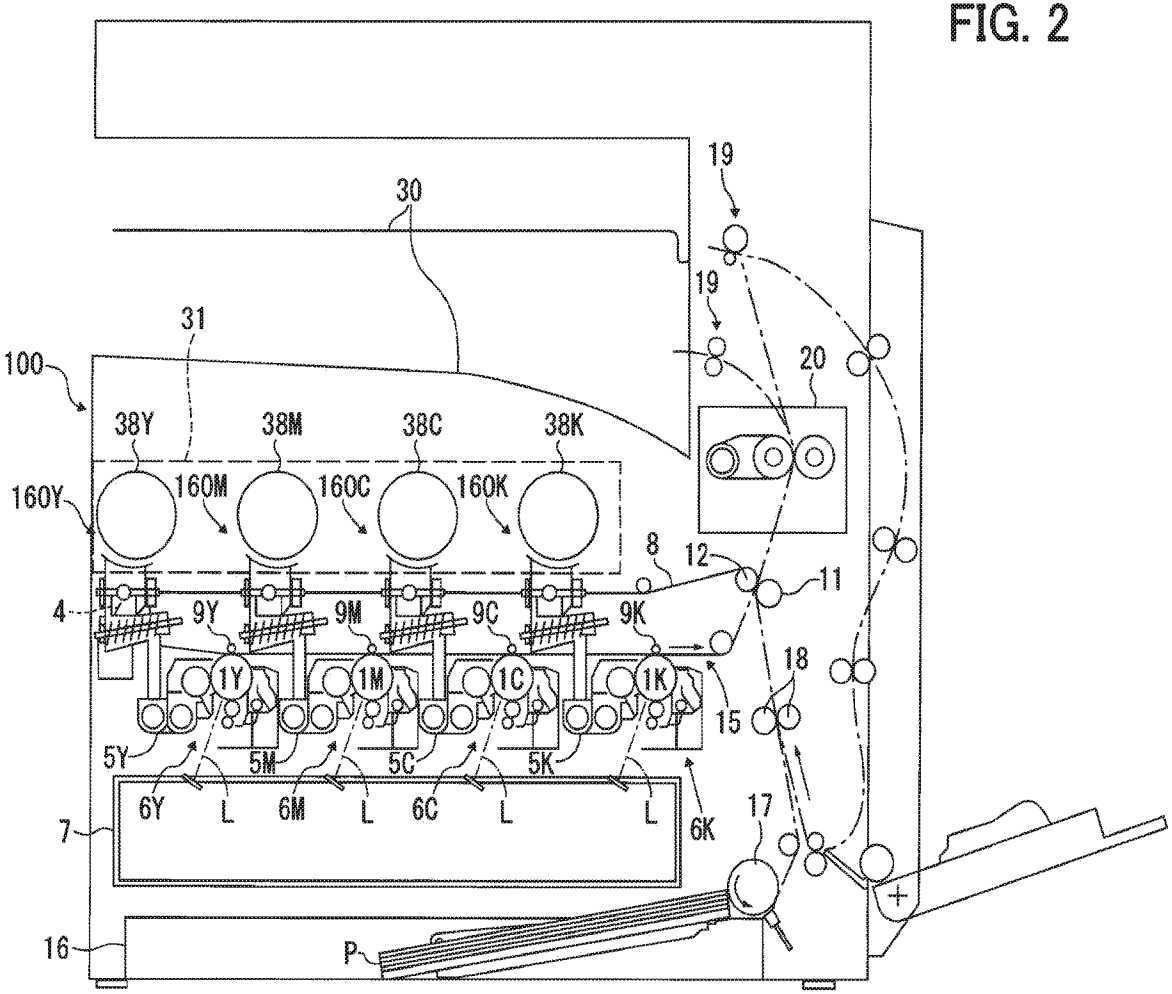
FIG. 2 is a configuration diagram of an image forming apparatus according to the present invention.

First, an overall configuration and operation of an image forming apparatus according to the present invention will be described. As shown in FIG. 2, four toner containers 38Y, 38M, 38C, 38K, which are powder containers for respective colors (yellow, magenta, cyan, black), are detachably (replaceably) installed in a toner container housing section 31 which is located on the upper side of a body 100 of an image forming apparatus and serves as a powder container housing section. An intermediate transfer unit 15 is arranged below the toner container housing section 31. Below an intermediate transfer belt 8 included in the intermediate transfer unit 15, imaging sections 6Y, 6M, 6C, 6K for the respective colors (yellow, magenta, cyan, black) are placed opposed to the intermediate transfer belt 8 and arranged in a belt travel direction. Here, in the embodiments, members for the respective colors (yellow, magenta, cyan, black) are distinguished by assigning symbols of (Y, M, C, B).

The toner containers 38Y, 38M, 38C, 38K contain powdery toners of respective colors. When the toner containers 38Y, 38M, 38C, 38K are attached to the toner container housing section 31, toner supply devices 160Y, 160M, 160C, 160K, which are powder supply devices facing the inside of the toner container housing section 31, supply (refill) the toners of the colors to developing devices in the imaging sections 6Y, 6M, 6C, 6K, respectively.

In this embodiment, as the imaging sections, the toner containers, and the toner supply device have approximately an identical configuration except toner colors, one configuration representative of each of them will be described hereinafter.

Figure 3:
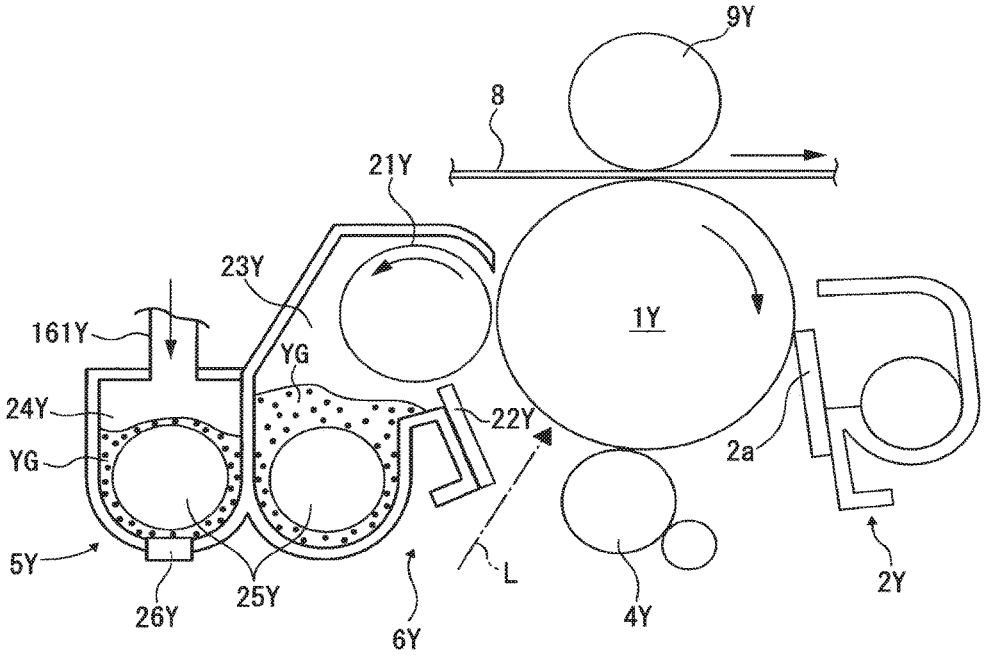
FIG. 3 is an enlarged view showing one embodiment of an image forming section that the image forming apparatus as shown in FIG. 2 includes.

As shown in FIG. 3, the imaging section 6Y for yellow is configured as a process cartridge including a photoconductive drum 1Y serving as an image carrier, as well as an electrical-charged section 4Y, a developing device 5Y (developing section), a cleaning section 2Y, a diselectrification section and the like, which are arranged around the photoconductor drum 1Y, and made detachably attachable to the body 100 of the image forming apparatus (see FIG. 2). Then, an imaging process (electrical-charging step, exposure step, development step, transfer step, and cleaning step) is performed to form a yellow image on the photoconductor drum 1Y.

In addition, other three imaging sections 6M, 6C, 6K also have an almost same configuration as the imaging section 6Y corresponding to yellow, except that a toner color to be used is different, and form images corresponding to respective toner colors.

In FIG. 3, the photoconductor drum 1Y is rotationally driven by a drive motor in clockwise direction shown by arrow in FIG. 3, and a surface of the photoconductor drum 1Y is uniformly charged at a position of the electrical-charged section 4Y (Electrical-charging step).

Then, on the surface of the photoconductor drum 1Y, laser beam L emitted from an exposure device 7 (see FIG. 2) reaches an irradiation position where as a result of exposure scanning, an electrostatic latent image corresponding to yellow is formed (Exposure step). The surface of the photoconductor drum 1Y reaches an opposed position (developing area) to the developing device 5Y, an electrostatic latent image at this position is developed, and an yellow toner image is formed (Development step).

The surface of the photoconductor drum 1Y after the development reaches a position opposed to the intermediate transfer belt 8 and a primary transfer bias roller 9Y where the toner image on the photoconductive drum 1Y is transferred to the intermediate transfer belt 8 (Primary transfer step). Then, there remains untransferred toner, albeit only slightly, on the photoconductor drum 1Y.

The surface of the photoconductor drum 1Y after the primary transfer reaches a position opposed to a cleaning device 2, where the untransferred toner remaining on the photoconductor drum 1Y is mechanically collected by a cleaning blade 2*a* (Cleaning step). The surface of the photoconductor drum 1Y reaches a position opposed to the diselectrification section, where any remaining potential on the photoconductor drum 1Y is removed. Now, a series of the imaging process performed on the photoconductor drum 1Y ends.

In addition, the imaging process described above is similarly performed to the yellow imaging section 6Y in other imaging sections 6M, 6C, 6K as well. More specifically, from the exposure device 7 arranged below the imaging section, laser beam L based on image information is emitted onto the photoconductor drums of the respective imaging sections 6M, 6C, 6K. Particularly, while emitting laser beam from a light source and scanning the laser beam L with a polygon mirror which is rotationally driven, the exposure device 7 irradiates it onto each photoconductive drum 1 via a plurality of optical elements. Then, a toner image of each color formed on each photoconductive drum after the development step is superposed on the intermediate transfer belt 8 and transferred. Thus, a color image is formed on the intermediate transfer belt.

The intermediate transfer unit comprises the intermediate transfer belt 8, four primary transfer bias rollers 9Y, 9M, 9C, 9K, a secondary transfer backup roller 12, a plurality of tension rollers, and an intermediate transfer cleaning section and the like. The intermediate transfer belt is not only stretched/supported, but also endlessly moved in the arrow direction in FIG. 2 by rotational driving of the secondary transfer backup roller 12.

The four primary transfer bias rollers 9Y, 9M, 9C, and 9K, respectively sandwich the intermediate transfer belt with the photoconductor drums 1Y, 1M, 1C, 1K, and form primary transfer nips. To the primary transfer bias roller 9Y, 9M, 9C, 9K is applied transfer bias opposite to toner polarity.

The intermediate transfer belt 8 runs in the arrow direction, and sequentially passes through the primary transfer nip of each primary transfer bias roller. Thus, the toner images of respective colors on the photoconductor drums 1Y, 1M, 1C, 1K are superposed on the intermediate transfer belt 8, and primarily transferred.

The intermediate transfer belt 8 on which the toner images of the respective colors are superposed and transferred to reach a position opposed to the secondary transfer roller 11. At this position, a secondary transfer backup roller 12 sandwiches the intermediate transfer belt 8 with the secondary transfer roller 11, and forms secondary transfer nips. The four-color toner images formed on the intermediate transfer belt 8 are transferred on a recording medium P such as transfer paper, etc. carried to positions of the secondary transfer nips. Then, there remains untransferred toner which was not transferred to the recording medium P. The intermediate transfer belt reaches a position of the intermediate transfer cleaning section, where the untransferred toner on the intermediate transfer belt 8 is collected. Thus, a series of the transfer process performed on the intermediate transfer belt 8 ends.

The recording medium P transferred to positions of the secondary transfer nips is that transferred from a paper feed section 16, which is arranged in the lower part of the body 100 of the image forming apparatus, via a paper feed roller 17 or a pair of resist rollers 18 and the like. Particularly, multiple sheets of recording medium P such as transfer paper and the like are stacked and stored in the paper feed section 16. Then, when the paper feed roller 17 is rotationally driven in anticlockwise direction in FIG. 2, a top recording medium P is fed to an inter-roller space of the resist rollers 18.

The recording medium P transferred to the pair of resist rollers once stops at a position of a roller nip of the pair of resist rollers which stopped the rotational drive. Then, the pair of resist rollers 18 is rotationally driven in line with timing of the color image on the intermediate transfer belt 8, and the recording medium P is transported to the secondary transfer nips. Thus, a desired color image is transferred onto the recording medium P. The recording medium P the color image of which was transferred at the position of the secondary transfer nips is transported to a position of a fixing section 20. Then, at this position, due to heat and pressure of a fixing belt and a pressurization roller, the color image transferred onto the surface is fixed on the recording medium P.

The recording medium P after the fixing is discharged to outside of the device by way of the inter-roller space of a pair of paper ejection rollers 19. The recording medium P ejected to outside of the device by the pair of paper ejection rollers 19 is sequentially stacked as output images on a stack section 30. Then, a series of image forming process on the image forming apparatus completes.

Next, with reference to FIG. 3, a configuration and operation of a developing device in an imaging section will be further described in detail. An imaging device 5Y comprises a developing roller 21Y opposed to a photoconductive drum 1Y, a doctor blade 22Y opposed to the developing roller 21Y, two transport screws 25Y arranged in developer containers 23Y and 24Y, a density detection sensor 26Y configured to detect density of a toner in a developer, and the like. The developing roller 21Y comprises a magnet fixedly installed therein and a sleeve turning around the magnet, and the like. The developer containers 23Y and 24Y contain a two-constituent developer YG consisting of a carrier and a toner. The developer container 24Y is in communication with a toner drop path 161Y via an opening formed in an upper part of the developer container.

The developing device thus configured operates in the following manner. The sleeve of the developing roller 21Y is turning in a direction of an arrow in FIG. 3. Then, the developer YG carried on the developing roller 21Y due to a magnetic field formed by the magnet moves on the developing roller 21Y with rotation of the sleeve. The developer YG in the developing device 5Y is adjusted so that a proportion of a toner in the developer (toner density) is within a predetermined range. Specifically, a toner contained in a toner container 38Y is supplied into the developer container 24Y from a toner supply device 160Y through the toner drop path 161Y, according to consumption of the toner in the developing device 5Y.

Then, the toner supplied into the developer container 24Y circulates in the two developer containers 23Y, 24Y, while being mixed and agitated by the two transport screws 25Y together with the developer YG (which is movement in a vertical direction on FIG. 3). The toner in the developer YG adheres to the carrier due to frictional electrification with the carrier, and is carried on the developing roller 21Y with the carrier by magnetic force formed on the developing roller 21Y.

The developer YG carried on the developing roller 21Y is transported in the direction shown by the arrow in FIG. 3, and reaches a position of the doctor plate 22Y. After the developer is adjusted to an adequate amount at this position, the developer YG on the developing roller 21Y is transported to a position (development area) opposed to the photoconductor drum 1Y. Then, a toner adheres to a latent image formed on the photoconductor drum 1Y, due to an electric field formed in the development area. Thereafter, the developer YG remaining on the developing roller 21Y reaches an upper area of the developer container 23Y with rotation of the sleeve, and leaves the developing roller 21Y in this position.

Now, toner supply devices 160Y, 160M, 160C, 160K and toner containers 38Y, 38M, 38C, 38K will be described. Respective toner supply devices and toner containers have an identical configuration, except a color of a toner in a toner container to be set. Thus, they will be described as a toner supply device 160 and a toner container 38 with no toner-color-identifying letter, Y, M, C, K, attached.

Figure 1A:
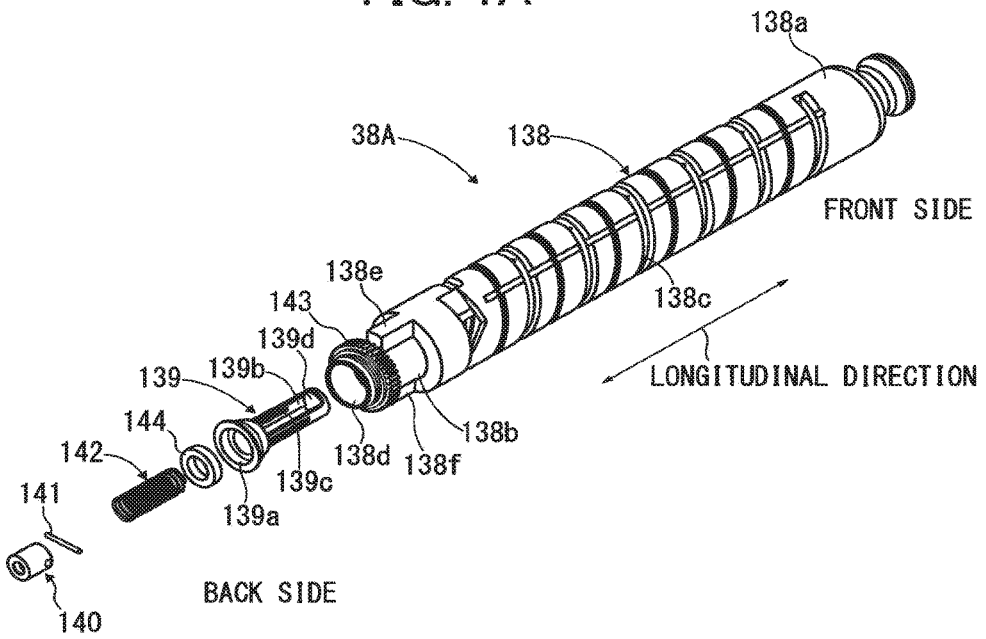
FIG. 1A is an exploded perspective view showing one embodiment of a powder container according to the present invention.
Figure 1B:
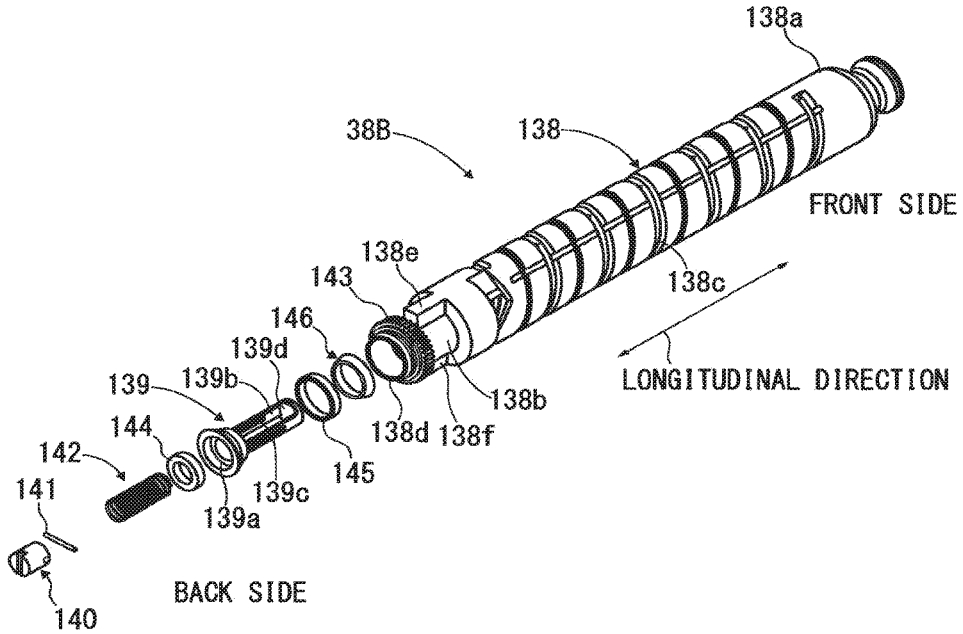
FIG. 1B is an exploded perspective view showing another embodiment of a powder container according to the present invention.

As shown in FIG. 1A and FIG. 1B, a toner container 38 according to a first embodiment of the present invention is roughly divided into two types.

Figure 4:
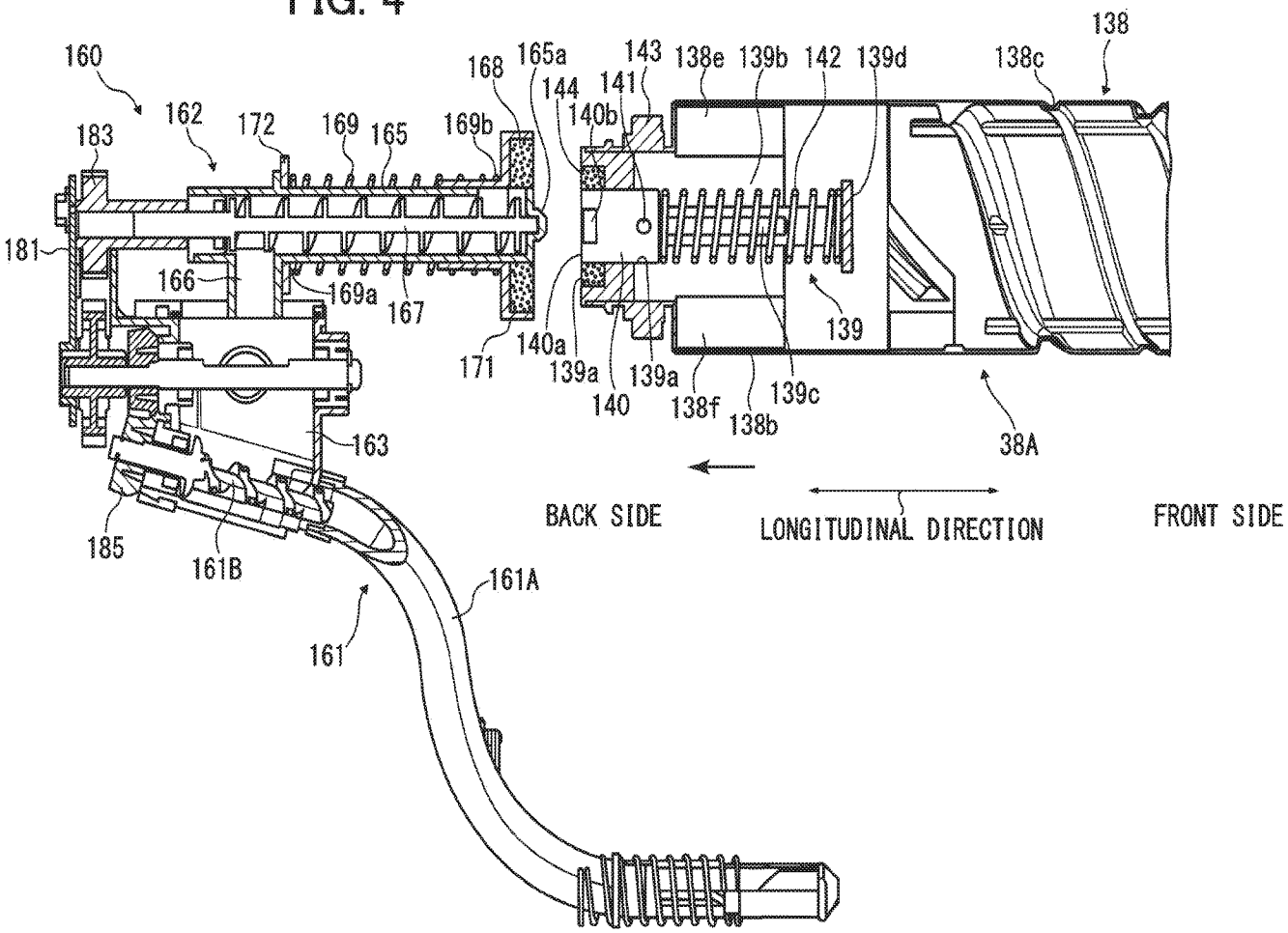
FIG. 4 is a partial sectional view showing a configuration of a powder supply device including the powder container shown in FIG. 1A.

A toner container 38A shown in FIG. 1A and FIG. 4 includes a container body 138 in which a toner is contained therein, a nozzle receiver 139 having a nozzle receiving hole (insertion section) 139 arranged on the second end side of the container body 138 and configured to allow a transport nozzle 162 having a powder receiving inlet 170 to be inserted therein, and a supply port 139*b* arranged in at least a part of the nozzle receiver and configured to supply a powdery toner in the container body 138, to the powder receiving inlet 170, and a shutter 140 which is an shutter supported by the nozzle receiver 139 and configured to open and close the nozzle receiving hole (insertion section) 139*a* by sliding in response to the insertion of the transport nozzle 162 into the nozzle receiver 139, and is of a type wherein the nozzle receiver 139 fixed to the container body 138 rotates integrally therewith.

The tubular container body 138 has helical projections 138*c*, which protrude toward the inside of the container, formed from a first end side 138*a* to the second end side 138*b* on its circumferential surface, and is configured to transport a toner contained therein from the first end side 138*a* to the second end side 138*b* as the container body 138 rotates.

On an end face of the second end side 138 *b* of the container body 138 are formed an opening 138*d* into which the nozzle receiver 139 is inserted, lift-up sections 138*e*, 138*f* for lifting up any toner transported by the helical projection 138*c* and accumulating in a lower part of the second end side 138*b* or any toner which has accumulated in the lower part of the second end side 138*b* from the beginning, in the container because of rotation of the container body 138, and a driving part, for example, a gear 143 to which a driving force for rotating the container body 138 is transmitted. In the embodiment, the lift-up sections 138*e*, 138*f* are such arranged that they are opposed to each other with their phases offset 180 degrees. Although there are multiple lift-up sections 138*e*, 138*f* in the embodiment, there may be any one of the lift-up sections 138*e*, 138*f*, which may be arranged as four lift-up sections with their phases offset 90 degrees. Alternatively, the lift-up sections may be increased to four or more, and may have a number and a shape which allow them to supply a toner to a supply port 139*b* and the powder receiving inlet 170, to be described below, from above them.

The nozzle receiver 139 forms approximately a cylindrical shape extending in a longitudinal direction of the container body 138. As shown in FIG. 4, on one end of the nozzle receiver is formed the nozzle receiving hole (insertion section) 139*a* fitting to the opening 138*d* formed on the container body 138. On an outer circumferential surface of the nozzle receiver 139 is formed a pair of slits 139*c* which extend in the longitudinal direction of the nozzle receiver 139 and are arranged to face each other. The nozzle receiver 139 has at an outer circumferential surface thereof a supply port 139*b* opened to extend in a longitudinal direction of the nozzle receiver 139. The nozzle receiving hole 139*a* and the supply port 139*b* are formed to be in communication in the nozzle receiver 139. The supply port 139*b* is such formed that at least a part thereof is located in a moving range of the shutter 140. A ring-shaped seal member 144 comprising a sponge member for preventing the toner from spilling is attached to the inside of the nozzle receiving hole 139*a*.

Figure 8:
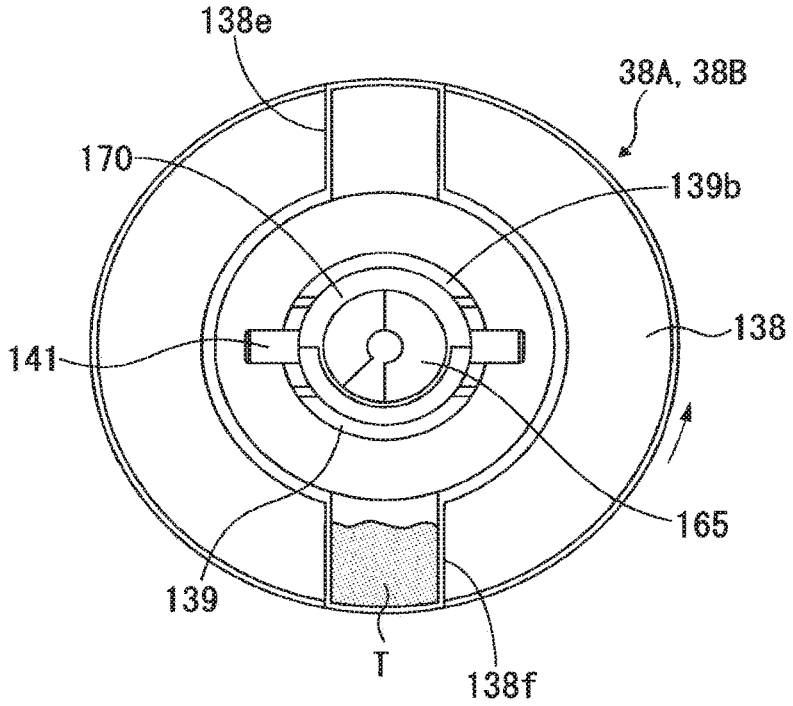
FIG. 8 is a cross sectional view showing that the powder container is attached to the transport nozzle.

The shutter 140 is a tubular shape and inserted into the nozzle receiver 139. The shutter 140 is movably supported in the longitudinal direction of the nozzle receiver 139, as it supports a pin 141, which diametrically penetrates, in each slit 139*c* of the nozzle receiver 139. A coil spring 142 which is an urging member is interposed between the end face 139*d* of the nozzle receiver 139 located opposite to the nozzle receiving hole 139*a* and the shutter 140. The shutter 140 is urged by the coil spring 142 to a position to close the nozzle receiving hole 139*a* (closed position), as shown in FIG. 4. The shutter 140 is configured to close a part of the supply port 139*b* as well as the nozzle receiving hole 139*a* when the closed position is closed. The shutter 140 is such configured that when the transport nozzle 162 is inserted into the nozzle receiver 139, the shutter 140 slides into the container from the closed position as shown in FIG. 4 to open the nozzle receiving hole 139*a* and the supply port 139*b*, and also moves to an open position as shown in FIG. 8 where the nozzle receiving hole 139*a* and the supply port 139*b* are in communication. In the embodiment, since the supply port 139*b* opens to an area adjacent to the nozzle receiving hole 139*a*, the nozzle receiving hole 139*a* and the supply port 139*b* are closed if the shutter 140 is in the closed position. However, if the supply port 139*b* is formed closer to the end face 139*b*, only the nozzle receiving hole 139*a* is closed when the shutter 140 is in the closed position.

The toner container 38A such configured is attached by sliding it from the front side to the back side of the body 100 of the image forming apparatus so that the second end side 138*b* of the container body 138 is located in the back side of a toner container storage 31.

The toner container 38B shown in FIG. 1B includes a container body 138 in which a toner is contained, a nozzle receiver 139, a shutter 140, and a gear 143, and is configured such that the nozzle receiver 139 is supported to be rotatable with respect to the container body 138. The container body 138 and the nozzle receiver 139 have the same configurations as in the toner container 38A shown in FIG. 1A. The toner container 38B differs from the toner container 38A in that an end of the shutter 140 has a different configuration and in that two members are added. Except for those differences, the configuration of a powder supply device including the toner container 38B is the same as in FIG. 4. In FIG. 1B, the toner container 38B further includes a bearing member indicated by reference numeral 145 and a seal member indicated by reference numeral 146. The ring-shaped bearing member 145 is interposed between an opening 138*d* of the container body 138 and a nozzle receiving hole 139*a* of the nozzle receiver 139, and supports the nozzle receiver 139 rotatably with respect to the container body 138. The seal member 146 is attached to the outer circumferential surface of the nozzle receiver 139 extending from the bearing member 145 toward the inside of the container body 138. In the seal member 146, an umbrella-like lip member 146*a* is inclined to and extends from a ring-shaped base continuously in a circumferential direction. The seal member 146 is made of a rubber or resin such that the seal member 146 can elastically deform and contact an inner circumferential surface of the opening 138*d* of the container body 138 when the nozzle receiver 139 is inserted into the container body 138.

The toner container 38B such configured is attached by sliding it from the front side to the back side of the body 100 of the image forming apparatus so that the second end side 138*b* of the container body 138 is located in the back side of a toner container storage section 31.

Figure 5:
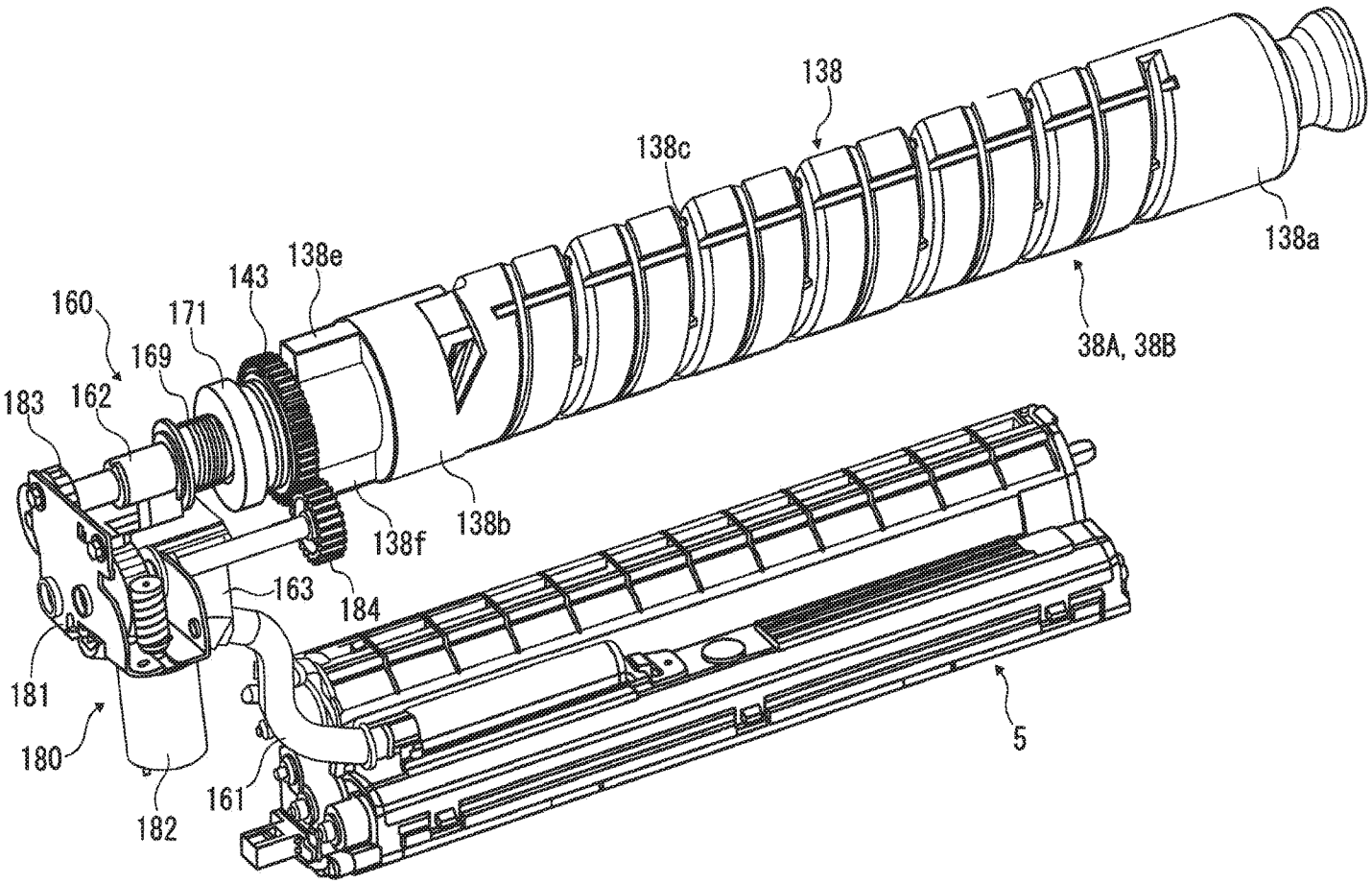
FIG. 5 is a perspective view showing an overall configuration of the powder container according to the present invention and showing that it is connected with a developing device.

There are two types of supply devices 160: One is used with the toner container 38A shown in FIG. 1A and the other with the toner container 38B shown in FIG. 1B. As they have a same configuration except for a connection section with the shutter 140, their common configuration will be described here, and differences in the configuration will be described individually. FIG. 5 is an overall diagram of the toner supply device 160. The toner supply device 160 shown in FIG. 4 is used with the toner container 38A shown in FIG. 1A.

Each of toner supply devices 160 has the toner container 38A, 38B, a toner nozzle 162, and a transport path 161 connected to the transport nozzle 162 and a developing device 5 and transporting a toner supplied to the transport nozzle to the developing device 5. The transport nozzle 162 is arranged in the back side of the toner container storage section 31 (the body 100 of the image forming apparatus) to be opposed to the shutter 140 which is inserted into the toner container storage section 31. A sub hopper 163 for storing a toner to be transported by the transport nozzle 162 is provided between the transport nozzle 162 and the transport path 161, and the toner is supplied to the transport path 161 via the sub hopper 163.

As shown in FIG. 4, the transport path 161 includes a hose 161A, and a transport screw 161B arranged in the hose 161A and transporting the toner from the sub hopper 163 to the developing device 5 by rotating.

The transport nozzle 162 includes a tubular nozzle section 165 to be inserted into the nozzle receiver 139 of the toner container 38A, 38B, a connection path 166 connecting the nozzle section 165 and the sub hopper 163, a transport screw 167 arranged in the nozzle section 165 and transporting the toner supplied from the toner containers 38A, 38B to the connection path 166, a seal member 168 forming a seal surface by contacting the seal member 144 of the shutter 140, and a coil spring 169 as an urging device.

The nozzle 165 extends in the longitudinal direction of the toner container, and its outer circumference can be inserted into the nozzle receiver 139 from the nozzle receiving hole 139*a*. On the outer circumferential surface on the tip side of the nozzle section 165 is formed a powder receiving inlet 170 which receives a toner from the supply port 139*b* of the toner container 38A, 38B and guides it to the transport screw 167. A length of the nozzle section 165 is set so that the powder receiving inlet 170 can be opposed to the supply port 139*b* when the nozzle section is inserted into the nozzle receiver 139.

The connection path 166 is formed integrally with a base end of the nozzle section 165 located on the opposite side of the powder receiving inlet 170, and in communication with the nozzle section 165. The powder receiving inlet 170 is such formed that it is located on a top face of the nozzle section 165.

A screw section 167*a* being formed from the tip of the nozzle section 165 to the connection path 166, and the transport screw 167 is rotatably supported by the nozzle section 165. The seal member 168, formed of a sponge and shaped like a ring, is attached to a holder 171 supported movably in the longitudinal direction in the outer circumferential surface of the nozzle section 165.

In the coil spring 169, one end 169*a* is latched to the holder 171 held slidably on the outer circumferential surface of the nozzle section 165 and rotatably about the axis center, and the other end 169*b* is latched to a spring receiving member 172 held on the outer circumferential surface of the nozzle section 165. In this state, the coil spring 169 urges the seal member 168 toward a seal member 144 (to a direction in which the holder 171 moves away from the spring receiving member 172).

The powder receiving inlet 170 is formed to be opposed to the supply port 139*b* of the nozzle receiver 139, when the nozzle section 165 is inserted into the container body 138 from the nozzle receiving hole 139*a* of the nozzle receiver 139.

A drive device 180 of the toner supply device 160 will be described. As shown in FIG. 5, the drive device 180 includes a drive motor 182 which is a drive source fixed to a frame 181, a gear 183 fixed to an end of the transport screw 167, a gear 184 to mesh with the gear 143 of the container body 138 when the toner container 38A, 38B is mounted to the toner container storage section 31 (see FIG. 2), a gear 185 fixed to an end of the transport screw 161B shown in FIG. 4, and a gear train meshing with the gears 183 to 185 and transmitting rotation of the drive motor 182 to each gear. The drive motor 182 is controlled by a control device so that the drive device will rotate for a certain period of time, when the control device detects a toner signal with the toner container 38A, 38B mounted to a toner container mount section 31.

For the toner supply device 160 shown in FIG. 4 which engages with the toner container 38A shown in FIG. 1A, a circular recessed section 140*b* is formed on an end face 140*a* of the shutter 140 of the toner container 38A, a protrusion 165*a* insertable into the recessed section 140*b* is formed at a tip of the nozzle section 165, and a contact face of the recessed section 140*b* and the protrusion 165*a* is made a sliding surface. In contrast, if the toner container 38B shown in FIG. 1B is used, a recessed section 140*c* is formed on the end face 140*a* of the shutter 140 of the toner container 38B, and a protrusion 165*b* may be formed at the tip of the nozzle section 165 so as to enter into the recessed section 140*b* and engage with the recessed section 140*c*, thereby fixing the shutter 140.

In the toner supply device 160 shown in FIG. 4, when the toner container 38A rotates, the shutter 140 held to the nozzle receiver 139 also rotates integrally. However, since the contact face of the recessed section 140*b* and the protrusion 165*a* is made the sliding surface, the rotation is not disturbed. In addition, in the toner container 38A, the nozzle receiver 139 is fixed to and integrated with the container body 138. Once the nozzle receiver 139 is fixed, a positional relationship with the container body 138 is established. Thus, when the nozzle receiver 139 is fixed to the container body 138, it is arranged so that at least the supply port 139*b* is opposed to the lift-up section 138*e* or the lift-up section 138*f* of the container body 138 and located at a position where a toner lifted by the lift-up sections drops.

In contrast, if the toner container 38B shown in FIG. 1B is used, the shutter 140 and the container body 138 rotate relatively because rotation of the shutter 140 is disturbed by engagement of the recessed section 140*c* and the protrusion 165*b*, and thus rotation of the nozzle receiver 139 is also disturbed, although the shutter 140 held to the nozzle receiver 139 of the toner container 38B is rotatably supported to the container body 138. In addition, when the toner container 38B shown in FIG. 1B is used, specifying a positional relationship of the supply port 139*b* and the lift-up sections 138*e*, 138*f* of the container body 138 is difficult because in a state before the toner container 38B is mounted to the toner container storage section 31, the nozzle receiver 139 and the container body 138 are supported so that they can relatively rotate. Thus, the recessed section 140*c* and the protrusion 165*c* can be configured as positioning means of the supply port 139*b* and the powder receiving inlet 170 so that positions of the supply port 139*b* and the powder receiving inlet 170 provided in the nozzle part 165 are aligned when the recessed section 140*c* engages with the protrusion 165*b*.

Figure 7:
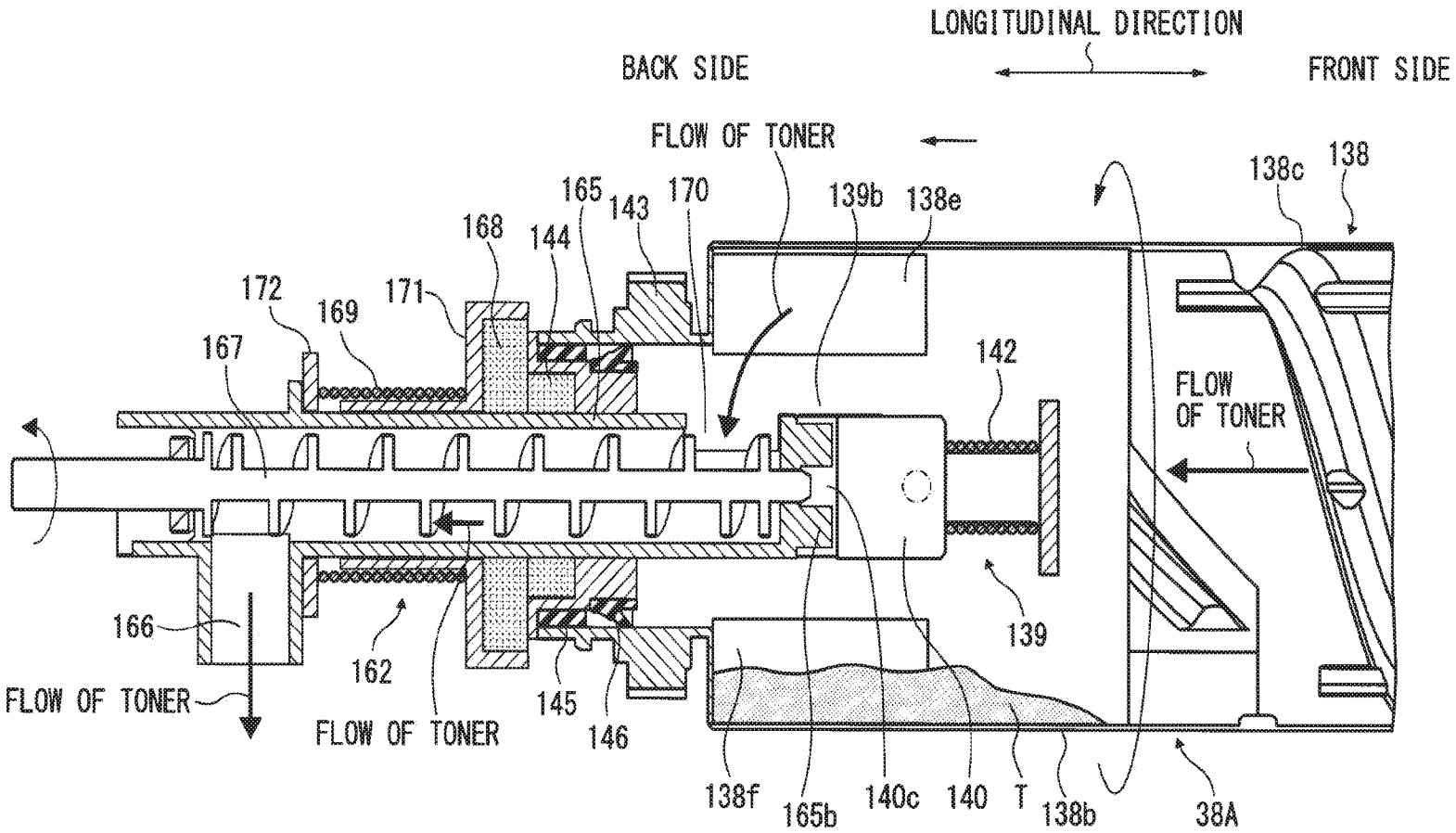
FIG. 7 is a sectional view showing that the transport nozzle that the powder supply device includes is attached to the powder container shown in FIG. 1B.

In the embodiment shown in FIG. 4 and FIG. 7, the powder receiving inlet 170 is formed on the top face of the nozzle member 165, and its orientation remains unchanged when the toner container 38A, 38B rotates. This is thus preferable since a toner in the toner container can be reliably supplied to the powder receiving inlet 170, if the recessed section 140*c* and the protrusion 165*b* are formed so that the supply port 139*b* faces the top face when each toner container is mounted to the toner container storage section 31.

With reference to FIG. 4 to FIG. 10B, operation of the toner supply device 160 thus configured will be described. While the toner container 38A, 38B is transported or stored before being mounted to the toner container storage section 31 shown in FIG. 2, the nozzle receiving hole 139*a* is closed by the shutter 140 urged by the coil spring 142. That is to say, the toner container is in an almost sealed state as communication between the nozzle receiving hole 139*a* and the supply port 139*b* is blocked. From this state, as shown in FIG. 4, the toner container 38A, 38B is horizontally inserted into the toner container storage section 31 with the opening 138*d* side as a tip side. As the insertion proceeds, the tip of the nozzle section 165 comes into contact with the end face 140*a* of the shutter 140. Then, in the case of the toner supply device 160 shown in FIG. 4, not only the protrusion 165*a* at the tip of the nozzle section 165 is inserted into the recessed section 140*b* of the shutter 140, but also the seal member 144 contacts the seal member 168. If the toner container 38B shown in FIG. 1B is used, the protrusion 165*b* of the nozzle section 165 engages with the recessed section 140*c* of the shutter section 140, and as a result of the engagement of both of them, the shutter 140 is fixed and positioned.

Figure 6:
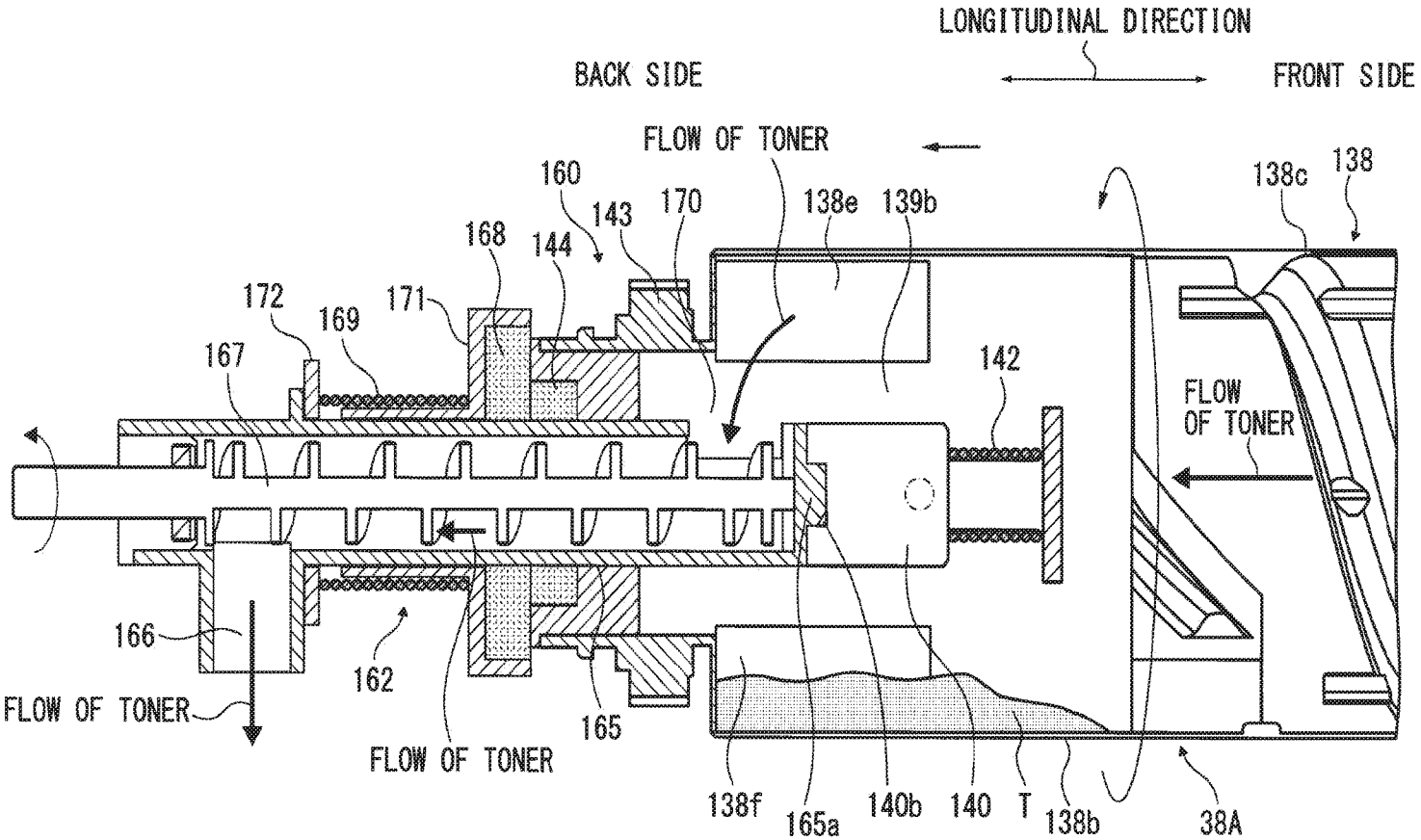
FIG. 6 is a sectional view showing that a transport nozzle that the powder supply device shown in FIG. 4 includes is attached to the powder container.

When the toner container 38A, 38B is further moved to the back side, as shown in FIGS. 6 and 7, the shutter 140 is pushed into the container body 138*b* by the nozzle section 165 against an urging force of the coil spring 142. In addition, with the movement of the toner container 38A, 38B, the seal member 168 is also pushed into the back side by the toner container 38A, 38B against urging force of the coil spring 169. Thus, the seal member 168 and the seal member 144 are in a state in which they are pressed against each other, and sealing of the nozzle receiving hole 139*a* is thus ensured. The toner container 38A, 38B stops moving when they are totally housed in the toner container section 31 and the first end side 138*b* of the container body 138 is rotatably supported by a support, and occupies a mounted position. The shutter 140 is further slid into the container by the nozzle section 165 until the toner container 38A, 38B occupies the mounted position. By the toner container 38A, 38B occupying the mounted position, the shutter 140 stops sliding and occupies an open position as shown in FIGS. 7 and 8. Then, not only the nozzle receiver 139*a* but also the supply port 139*b* are opened, and as shown in FIG. 8, the powder receiving inlet 170 is formed in the nozzle receiver 139 and opposed to the supply port 139*b* located above, and thus communicates with the inside of the toner container.

With the toner container 38A, 38B such configured, as the toner container 38A, 38B has the nozzle receiver 139 arranged on the second end side 138*b* of the container body 138 and configured to allow the nozzle section 165 of the transport nozzle 162 having the powder receiving inlet 170 to be inserted therein and supply the toner in the container body 138 to the powder receiving inlet 170, and the shutter 140 supported by the nozzle receiver 139 to be able to open and close the nozzle receiving hole 139*a* and sliding in response to an insertion of the nozzle section 165 into the nozzle receiver 139 to open and close at least the nozzle receiving hole 139*a* and the supply port 139*b* leading to the nozzle receiving hole 139*a* in the embodiment, the nozzle receiving hole 139*a* and the supply port 139*b* are kept in a closed state until the nozzle section 165 is inserted into the nozzle receiver 139. When the shutter 140 slides in response to the insertion of the nozzle section 165 into the nozzle receiver 139, the nozzle receiving hole 139*a* is opened and the shutter 140 pushes away any toner accumulated around the supply port 139*b* into the container. Consequently, a space is secured around the supply port 139*b*, which enables reliable supply of toner T to the powder receiving inlet 170. Thus, the toner contained in the container can be reliably discharged to the outside of the container, while preventing the toner T from spilling and flying.

When the image forming apparatus is actuated with the toner container 38A, 38B located at the mounted position, and when a toner supply signal is outputted from the control device, the drive motor shown in FIG. 5 is rotationally driven. When the drive motor 182 is rotationally driven, its drive force is transmitted to the gear 143 via the gear 184, thus rotating the toner container 38A, 38B. The drive force of the drive motor 182 is also transmitted to the transport screw 167 in the nozzle section 165, and the transport screw 167 rotates in a direction to transport the toner to the connection path 166. In addition, the drive force of the drive motor 182 is also transmitted to the transport screw 161B in the connection path 161 via the gear 185 as shown in FIG. 4, and the transport screw 161B rotates in a direction to transport the toner to the developing device 5.

When the toner container 38A, 38B rotates, the toner contained in the container is transported to the second end side 138*b* by an action of a helical groove 138*c* and also the transported toner T is mixed with a toner accumulated in the lower part of the second end side 138*b*.

Figure 9A:
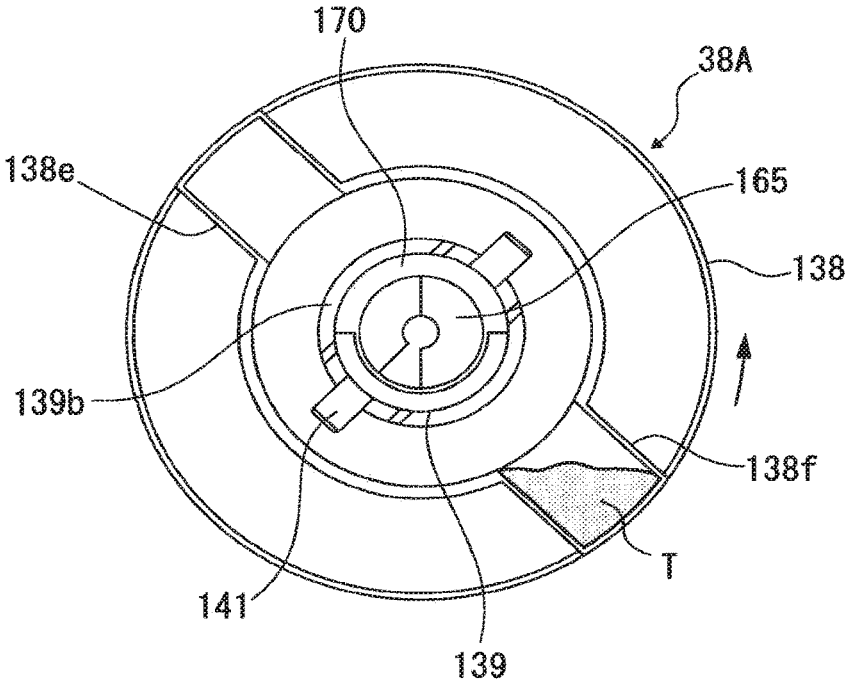
FIG. 9A is a view showing a positional relationship of a supply port and a lift-up section when the powder container shown in FIG. 1A is rotated.
Figure 9B:
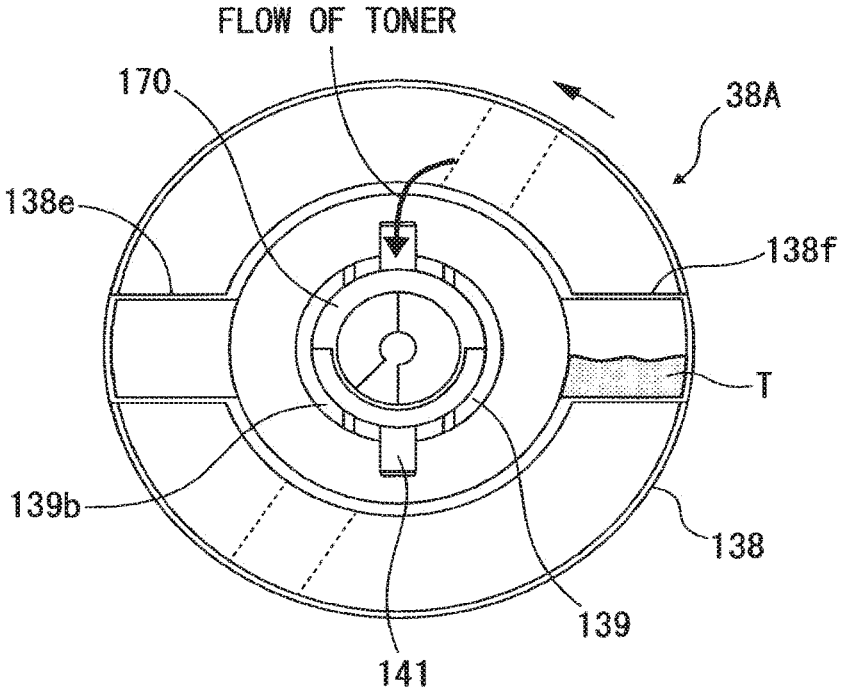
FIG. 9B is a view showing that the supply port which moves as a result of rotation of the powder container is misaligned with a position of a powder receiving inlet.

The supply port 139*b* formed in the nozzle receiver 139 and the lift-up section 138*f* of the container are in a fixed positional relationship. Thus, as shown in FIG. 9A, when the toner container 38A rotates, due to the rotation, the toner T accumulated in the lower part of the container is lifted up in the container by the lift-up section 138*f* and drops on the way. As shown in FIG. 9B, the toner T is supplied into the nozzle section 165 via the powder receiving inlet 170 when the powder receiving inlet 170 of the nozzle section 165 almost matches in position the supply port 139*b* which moves circumferentially due to the rotation.

Figure 10A:
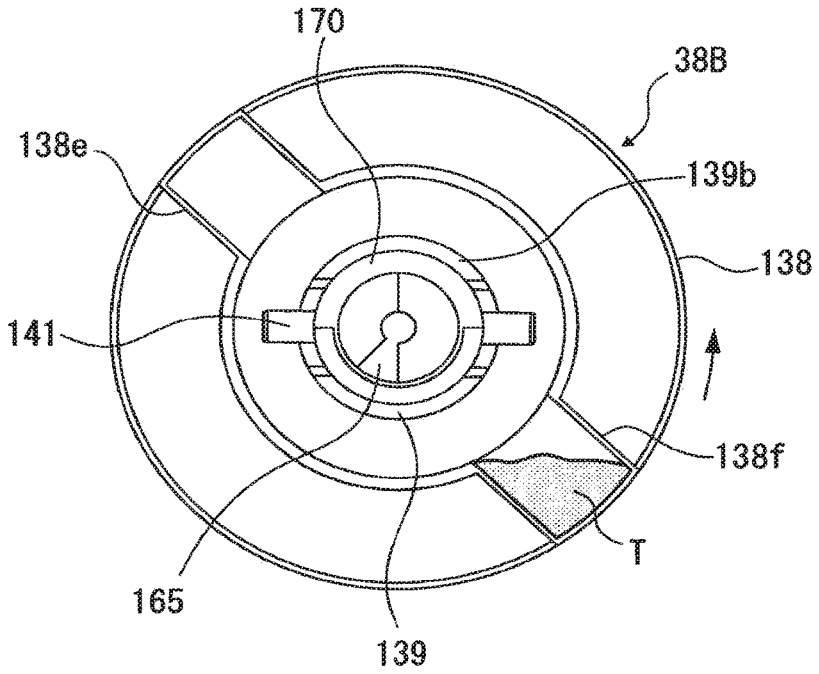
FIG. 10A is a view showing a positional relationship of the supply port, the powder receiving inlet, and the lift-up section when the powder container shown in FIG. 1B is rotated.
Figure 10B:
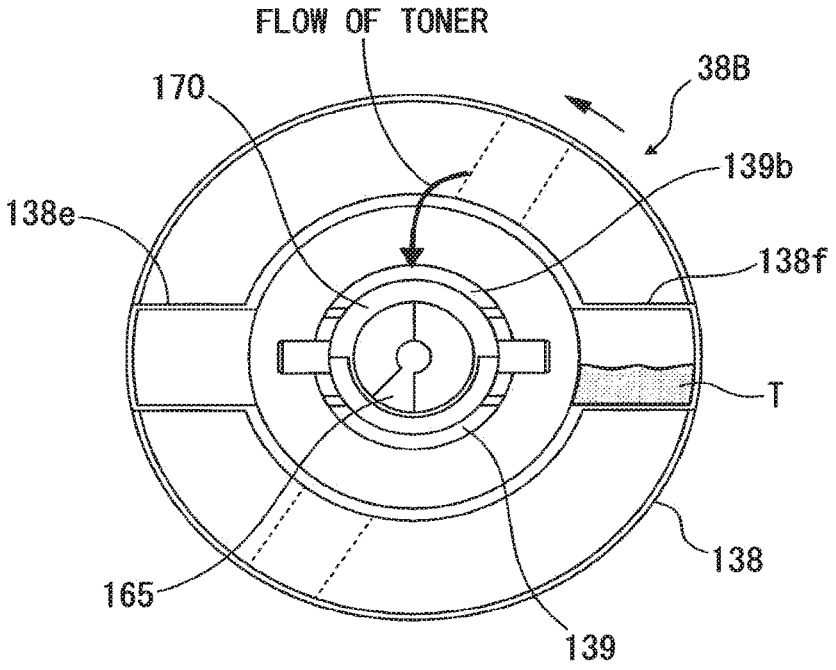
FIG. 10B is a view showing that a toner is supplied to the supply port and the powder receiving inlet when the powder container is rotated.
Figure 11A:
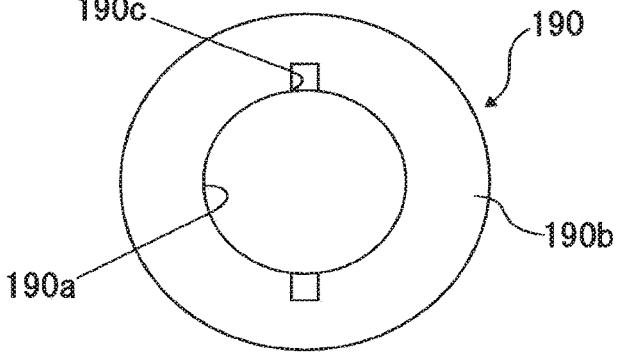
FIG. 11A is a front view showing a configuration of a ring-shaped loosening member.
Figure 11B:
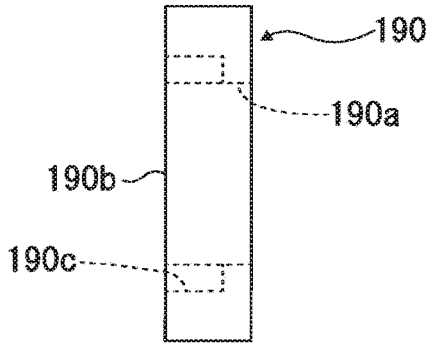
FIG. 11B is a side view of FIG. 11A.
Figure 12A:
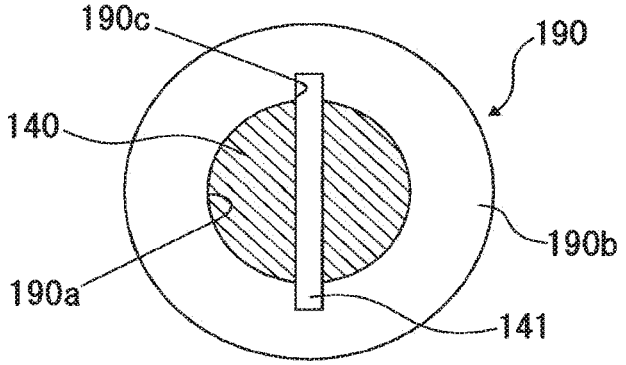
FIG. 12A is a sectional view showing that the ring-shaped loosening member is integrated with a shutter.
Figure 12B:
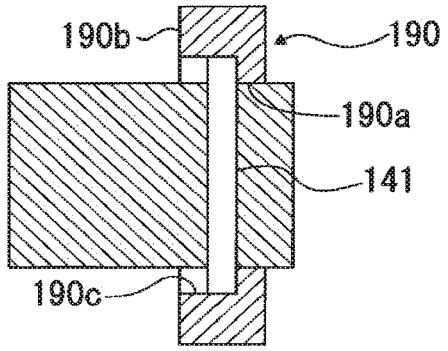
FIG. 12B is a lateral cross sectional view of FIG. 12A.

The powder receiving inlet 170 provided in the nozzle section 165 and the supply port 139*b* formed in the nozzle receiver 139 are in a fixed positional relationship. Thus, as shown in FIG. 10A, when the toner container 38A rotates, due to the rotation, the toner T accumulated in the lower part of the container is lifted up in the container alternately by the lift-up section 138*e*, 138*f*, during which, as shown in FIG. 10B, the toner T drops and is supplied into the nozzle section 165 via the supply port 139*b* and the powder receiving inlet 170.

That is to say, in the case of the toner container 38A, the toner T in the container is supplied into the nozzle section 165 only while the powder receiving inlet 170 of the nozzle section 165 and the supply port 139*b* of the nozzle receiver 139 overlap in one turn of the container. In the case of the toner container 38B, the toner T in the container is supplied into the nozzle section 165 every time the lift-up sections 138*e*, 138*f* pass over the powder receiving inlet 170 of the nozzle section 165 and the supply port 139*b* provided in the nozzle receiver 139, positions of which match, in one turn of the container.

The toner T supplied into the nozzle section 165 is transported by the transport screw 167 toward the connection path 166, and drops on the connection path 166. The dropped toner T is fed into the transport path 161 via the sub hopper 163 shown in FIG. 4, and transported and supplied to the developing device 5 by rotation action of the transport screw 161B.

A toner container 38C, 38D, as a powder container, is made by adding a loosening member 190 for breaking down the toner accumulated near the supply port 139*b* to the toner container 38A, 38B as shown in FIGS. 1A and 1B. As a configuration of the toner container 38C, 38D is same as the toner container 38A, 38B, except for the loosening member 190, a configuration of the loosening member 190 and action thereby will be mainly described now.

Figure 13:
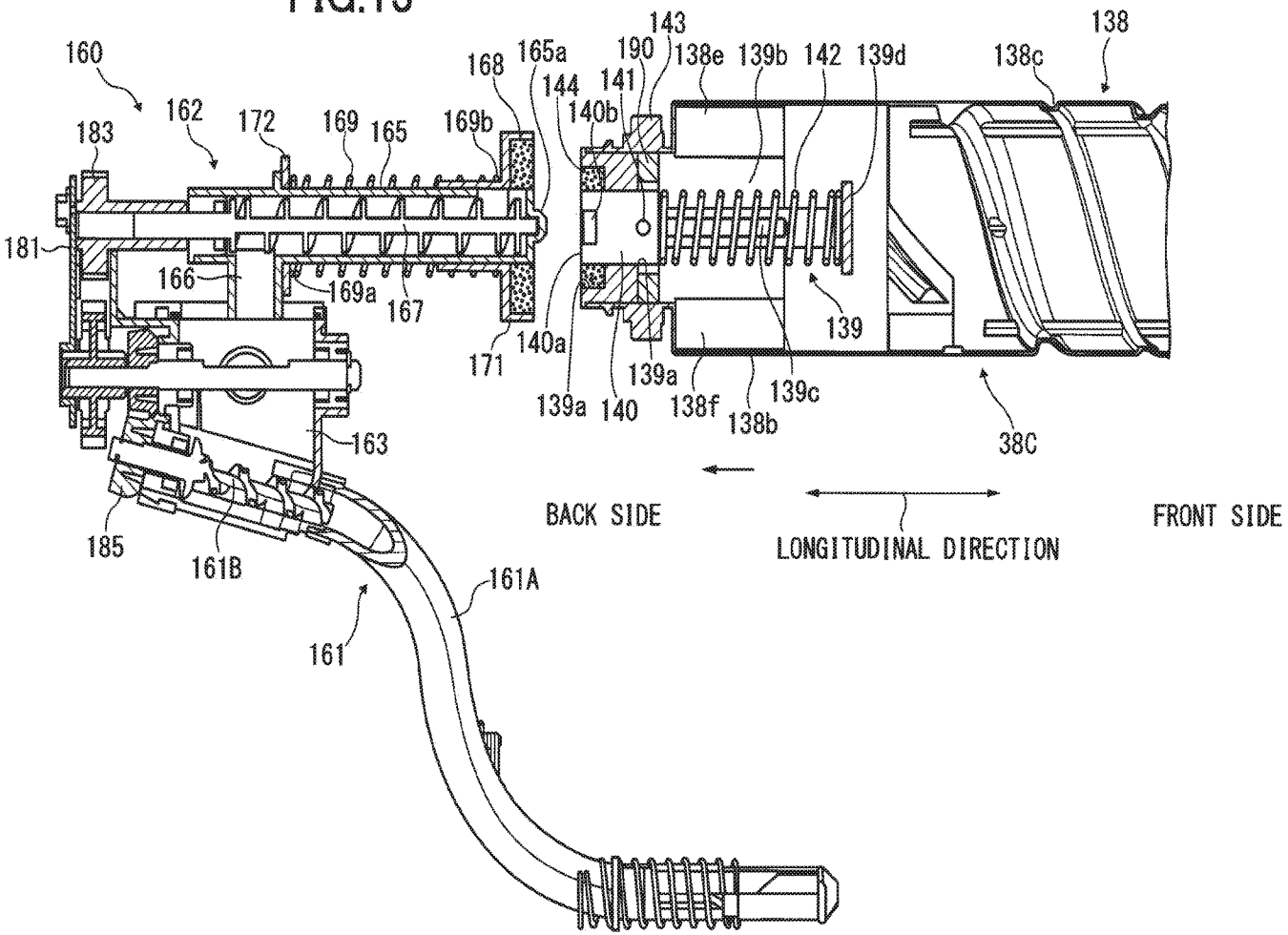
FIG. 13 is a partial cross sectional view showing a configuration of a powder supply device including a powder container according to the present invention which has a loosening member.

As shown in FIGS. 11A, 11B and 12A, 12B, the loosening member 190 is a ring member at the center of which a through-hole 190*a* is formed, and in which a groove 190*c* for fitting to a pin 141 which penetrates a shutter 140 is formed in one lateral face 190*b*. As shown in FIG. 13, an outer circumferential surface of a nozzle receiver 139 is inserted into the through-hole 190*a*. The pin 141 of the shutter 140 housed inside the nozzle receiver 139 is fitted to the groove 190*c* from the lateral face 190*b* side. With this structure, the loosening member 190 is made movable integrally with the shutter 140 while protruding from the nozzle receiver 139 toward the inside of the toner container.

In summary, the loosening member 190 is a member protruding from the nozzle receiver 139 toward the inside of the container body 138 and configured to be movable in the moving direction of the shutter 140 in conjunction with opening and closing operations of the shutter 140.

Figure 14:
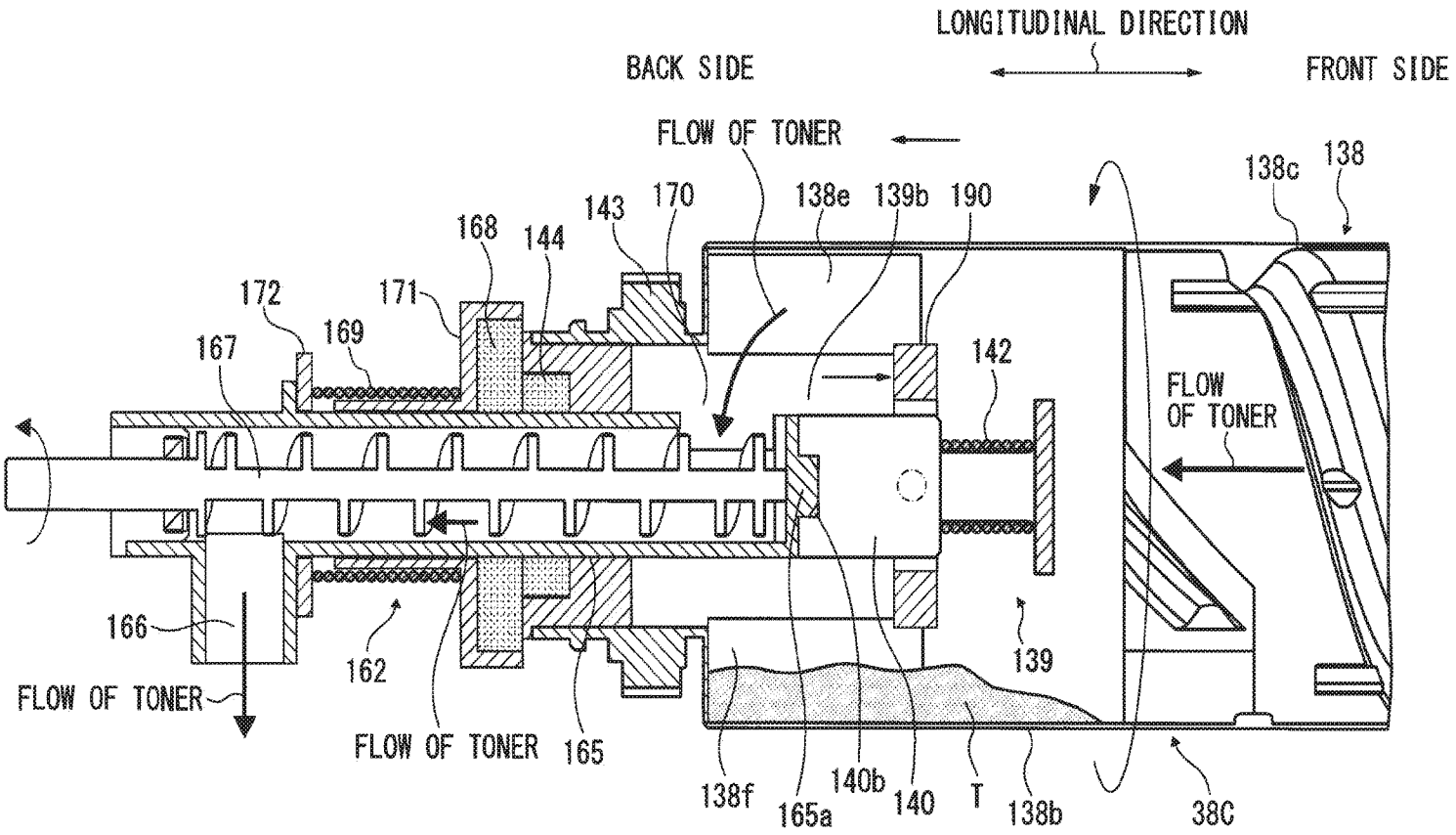
FIG. 14 is a cross sectional view showing that the transport nozzle that the powder supply device shown in FIG. 13 includes is attached to the powder container.

The loosening member 190 is mounted to the shutter 140 so as to be arranged on the inner end 140*d* side of the shutter 140. When the shutter 140 occupies the closed position as shown in FIG. 13, the loosening member 190 occupies a first position between the second end side 138*b* of the container body 138 and the end of the supply port 139*b*. When the shutter 140 occupies the open position as shown in FIG. 14, the loosening member occupies a second position between the first end side 138*a* of the container body 138 and the supply port 139*b*. Specifically, the loosening member 190 moves to and from the first and second positions with movement of the shutter 140.

With the configuration provided with such a loosening member 190, as shown in FIG. 14, a space can be secured more easily around the supply port 139*b*, by the action of pushing away any toner accumulated near the supply port 139*b* as a result of sliding of the shutter 140, breaking down any toner accumulated near the supply port 139*b* as a result of movement of the loosening member 190, and rubbing through the toner accumulated near the supply port 139*b*, more specifically, on the nozzle receiver 139. This enables reliable supply of the toner from the supply port 1139*b* to the powder receiving inlet 130. Thus, powder contained in the toner container 38C, 38D can be reliably discharged to the outside of the container, while preventing the powder from spilling and flying from the container.

Figure 15A:
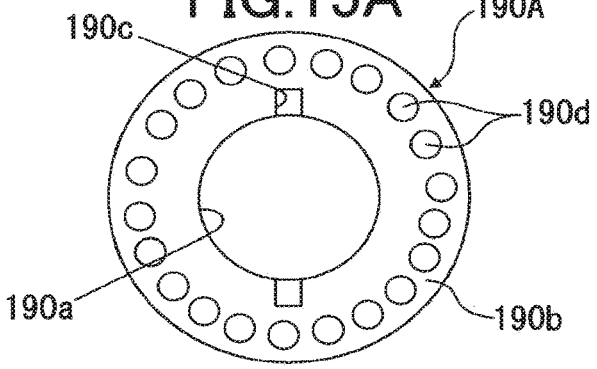
FIG. 15A is a front view showing an embodiment of a loosening member having a plurality of openings.
Figure 15B:
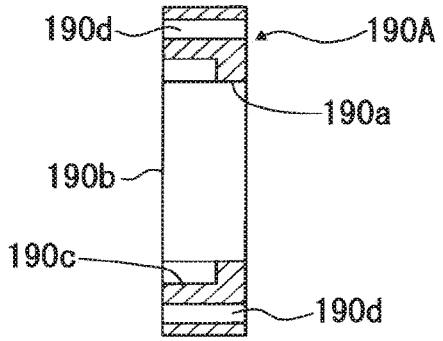
FIG. 15B is a side cross sectional view of FIG. 15A.

Since the loosening member 190 as shown in FIGS. 11A, 11B and 12A, 12B is a ring member, it is expected that sliding resistance when the loosening member rubs through a toner increases, if it slides in the longitudinal direction of the nozzle receiver 139 as the shutter 140 moves. Thus, as shown in FIGS. 15 A and 15B, for example, the loosening member may be a loosening member 190A having an opening 190*d* which penetrates in its own moving direction. In this case, the number and area of the opening 190*d* may vary depending on the sliding resistance. For example, if sliding resistance while the shutter 140 moves is large, the opening area may be increased. If the sliding resistance is small, no opening 190*d* may be formed or the opening area may be reduced. As shown in FIGS. 15 A and 15B, as means for adjusting the opening area, multiple openings 190*d* may be formed or adjustment may be made by changing size of the opening 190*d*.

Figure 16A:
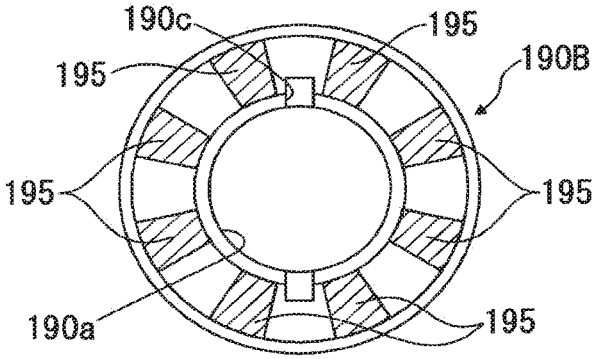
FIG. 16A is a front view showing an embodiment of a loosening member formed of a vane member.
Figure 16B:
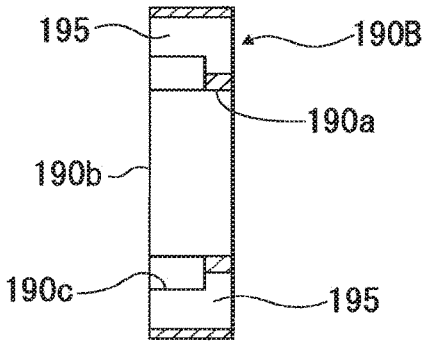
FIG. 16B is a side cross sectional view of FIG. 16A.
Figure 17A:
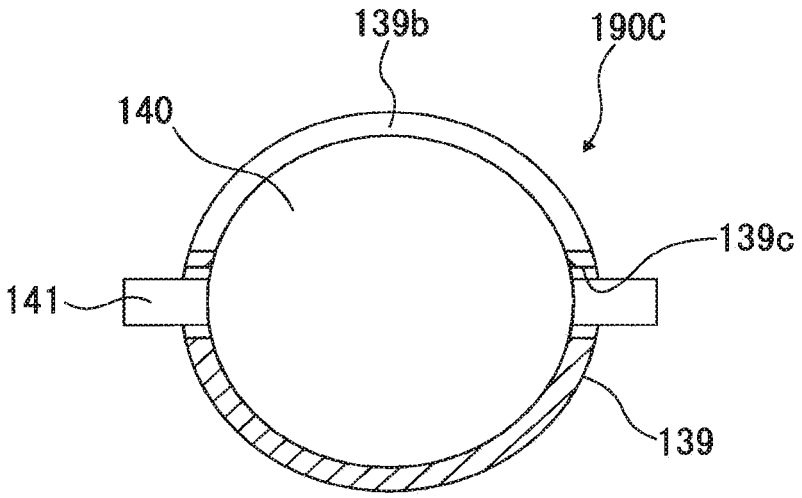
FIG. 17A is a cross sectional view showing one embodiment in which a loosening member is configured by a pin which supports an shutter to a nozzle receiver.
Figure 17B:
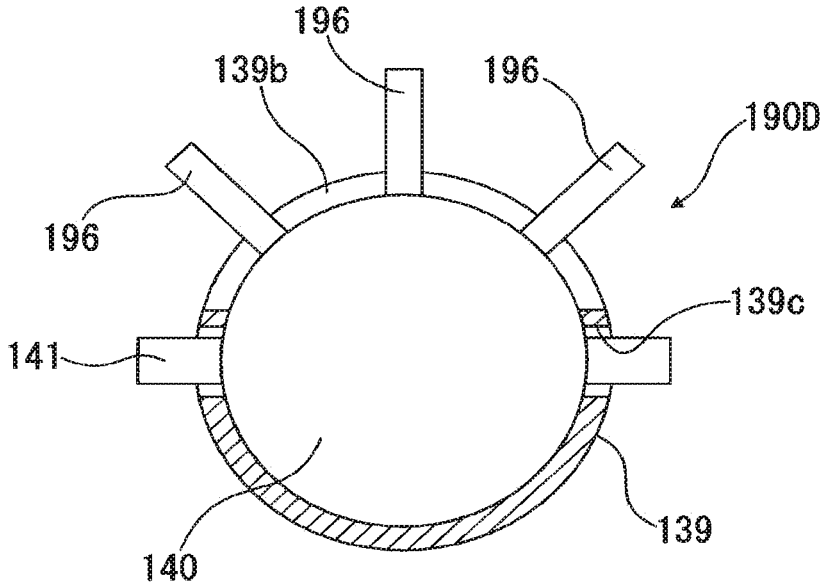
FIG. 17B is a cross sectional view showing an embodiment in which the loosening member is configured by a pin provided in the shutter.

A form of the loosening member shall not be limited to a ring shape. For example, it may be a loosening member 190B, as shown in FIGS. 16 A and 16B, configured to have multiple vane members 195 spaced in a circumferential direction, a loosening member 190C, as shown in FIG. 17A, configured to have the pin 141 protruded toward the inside of the container from the surface of the nozzle receiver 139 by extending total length of the pin 141, or a loosening member 190D, as shown in FIG. 17B, configured by one or more pin 196 which protrudes from the surface of the shutter 140 more into the container than to the surface of the nozzle receiver 139. The form of the loosening members may be selected and defined as appropriate, depending on the sliding resistance while the shutter 140 slides, the inside shape of the toner container, or toner flow characteristics.

Second Embodiment

Now, toner supply devices 160Y, 160M, 160C, 160K and toner containers 38Y, 38M, 38C, 38K according to a second embodiment of the present invention will be described hereinafter. As the toner supply devices and toner containers have an identical configuration, except a color of a toner in a toner container to be set, they will be described as a toner supply device 160 and a toner container 38 with no toner-color-identifying letter, Y, M, C, K, attached.

Figure 18:
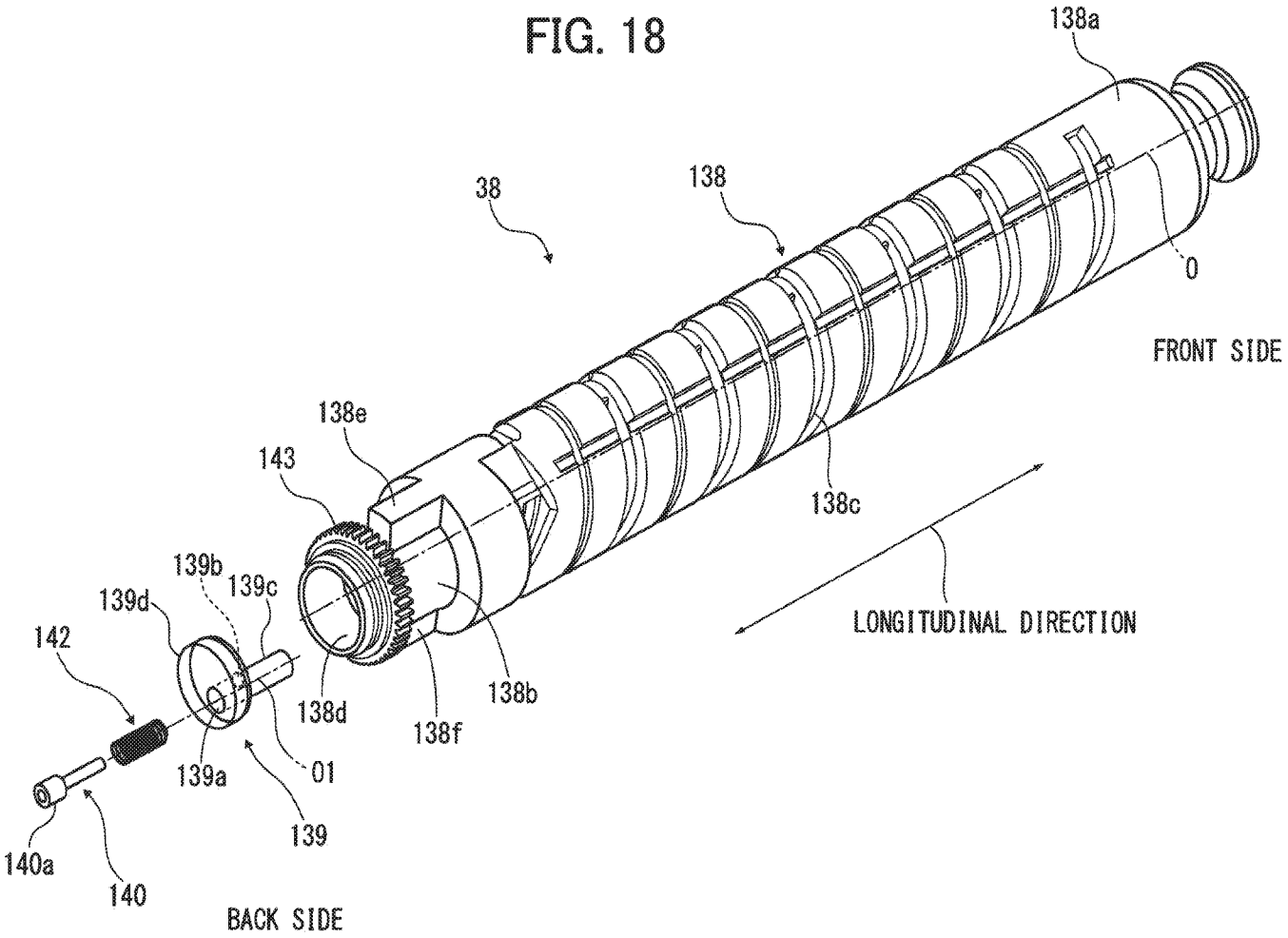
FIG. 18 is an exploded perspective view showing one embodiment of a powder container according to the present invention.
Figure 19:
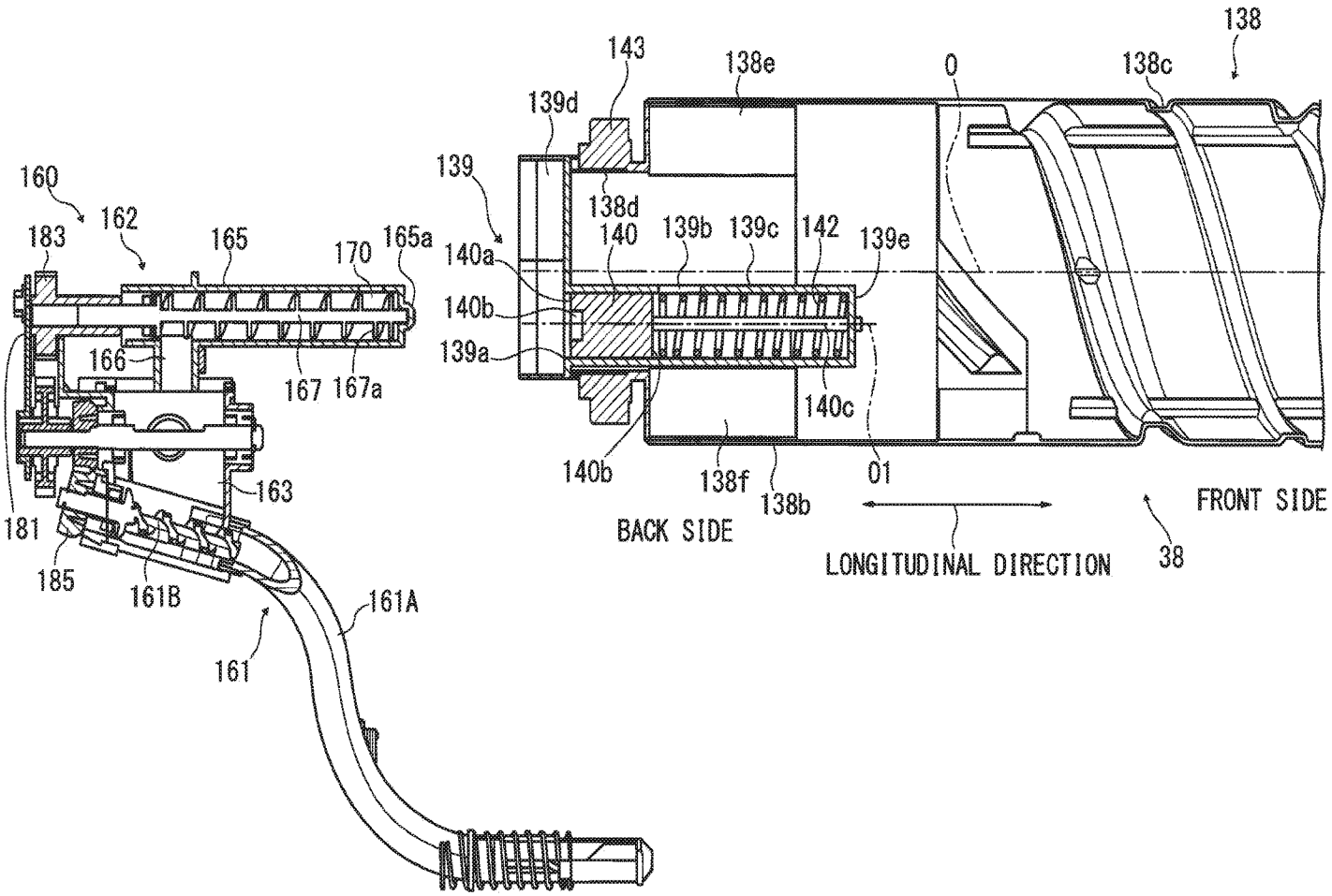
FIG. 19 is a partial sectional view showing a configuration of a powder supply device including the powder container shown in FIG. 18.

The toner container 38A shown in FIG. 18 and FIG. 19 includes a container body 138 in which a toner is contained therein, a nozzle receiver 139 having a nozzle receiving hole (insertion section) 139*a* arranged on the second end side of the container body and configured to allow a transport nozzle 162 having a powder receiving inlet 170 to be inserted therein, and a supply port 139*b* configured to supply a powdery toner in the container body 138 to the powder receiving inlet 170, and a shutter 140 which is an shutter movable in a direction to open and close the nozzle receiving hole 139*a*. Now, the nozzle receiver 139 having the nozzle receiving hole 139*a* and the container body 138 rotate relatively. In the figures (also including subsequent figures), illustration of bearing members, seal members and the like on a connection with the nozzle receiver 139 and the container body 138 is omitted. Then, in the toner container 38, the nozzle receiving hole 139*a* is arranged inside the outer circumference of the container body 138, and the center of the nozzle receiving hole 139*a* O1 is offset from the center of rotation of the container body 138 as shown by letter O.

The tubular container body 138 has helical projections 138, which protrude toward the inside of the container, formed from the first end side 138*a* to the second end side 138*b* on its circumferential surface, and is configured to transport a toner contained therein from the first end side 138*a* to the second end side 138*b* as the container body 138 rotates.

An end face of the second end side 138 *b* of the container body 138 is provided with an opening 138*d* into which the nozzle receiver 139 is inserted, lift-up sections 138*e*, 138*f*, and a gear 143 to which driving force for rotating the container body 138 is transmitted. A toner transported by the helical projection 138*c* and accumulated in a lower part of the second end side 138*b* or a toner accumulated in the lower part of the second end side 138*b* from the beginning is lifted up by the lift-up sections 138*e*, 138*f* with the rotation of the container body 138. In the embodiment, the lift-up sections 138*e*, 138*f* are arranged opposed to each other with their phases offset by 180 degrees. Although there are plural lift-up sections 138*e*, 138*f* in the embodiment, there may be any one of the lift-up sections 138*e*, 138*f*, or may be four lift-up sections arranged as with their phases offset by 90 degrees. Alternatively, four or more lift-up sections may be provided. The lift-up sections may have any number and any shape as long as the number and the shape allow a toner to be supplied from above to a supply port 139*b* and the powder receiving inlet 170 to be described below.

The nozzle receiver 139 includes a main body tubular section 139*c* formed as an almost cylindrical shape extending in a longitudinal direction of the container body 138, a ring-shaped bottomed mount section 139*d* formed on one end of the main body tubular section 139*c* and configured to be mounted to the container body 138, and the nozzle receiving hole (insertion section) 139*a* which is in communication with the main body tubular section 138*c* and into which the transport nozzle is inserted. Then, the nozzle receiving hole 139*a* and the main body tubular section 139*c* are arranged on a coaxial line, and formed so that the center of the mount section 139*d* corresponds to the center of rotation O of the container body 138. The nozzle receiving hole 139*a* and the main body tubular section 139*c* are formed so that the central part thereof is offset downward with respect to the center of the mount section 139*d* (the center of rotation O of the container body 138). The supply port 139*b* communicating with the nozzle receiving hole 139*a* via the main body tubular section 139*c* opens and is formed on an outer circumferential surface of the main body tubular section 139*c*.

In the embodiment, the central part of the nozzle receiving hole 139*a* is arranged at the lowest position on the upstream side of the rotation direction of the container body 138. In the embodiment, the container body 138 rotates in an anti-clockwise direction in FIG. 18 and FIG. 19.

The supply port 139*b* is such formed that at least a part thereof is located in the moving range of the shutter 140. A ring-shaped seal member formed of a sponge member for preventing a toner from spilling is mounted between the nozzle receiver 139*a* and the container body 138.

As shown in FIG. 18 and FIG. 19, the shutter 140 and a coil spring 142, urging means, are inserted into the main body tubular section 139*c*. The coil spring 142 is inserted between a bottom 139*e* of the main body tubular section 139 and a bottom 140*b* of the shutter 140 located in the main body tubular section 139*c*, and urges the shutter 140 toward a position (closed position) to close the nozzle receiving hole 139*a* and the supply port 139*b*, as shown in FIG. 19.

Figure 20:
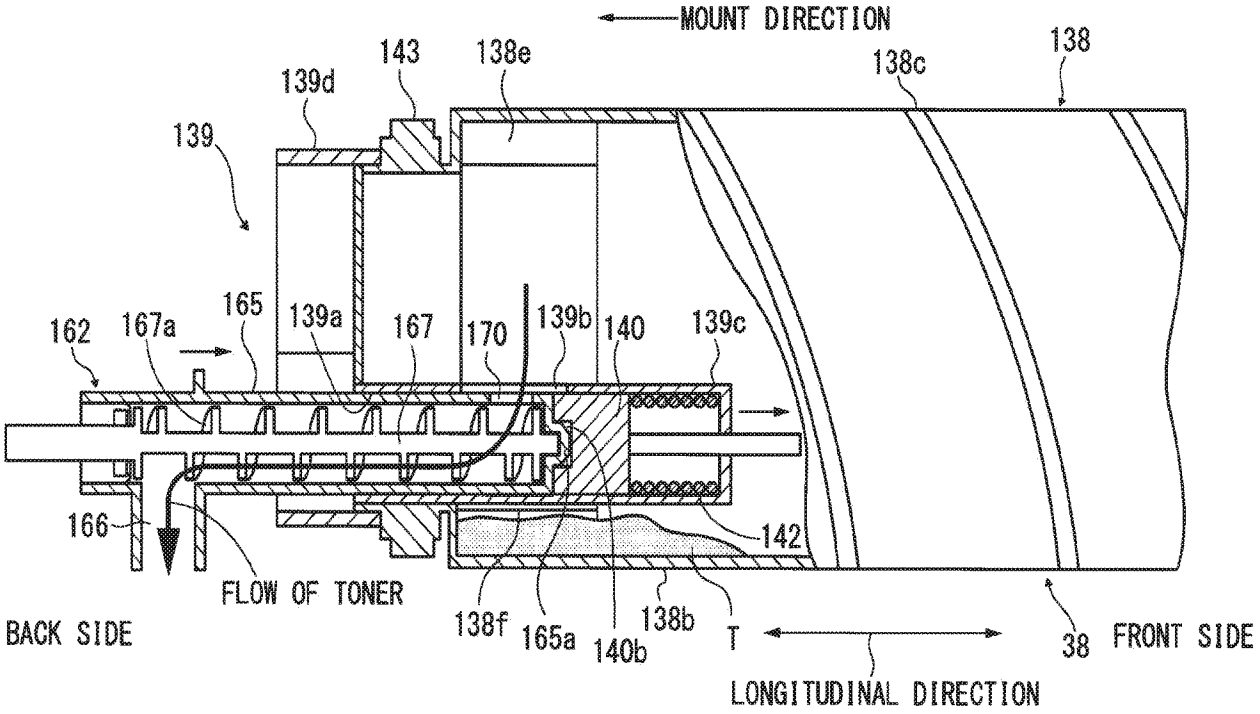
FIG. 20 is a cross sectional view showing that a transport nozzle that the powder supply device includes is attached to the powder container.

The main body tubular section 139*c* is located in an internal space where at least the supply port 139*b* is opposed to the lift-up sections 138*e*, 13*f* when the nozzle receiver 139 is mounted to the container body 138, and formed to length whereby the supply port 139*b* can ensure a stroke of the shutter 140 when the opening shutter 140 occupies an open position shown in FIG. 20. That is to say, the supply port 139*b* is provided so that it is opposed to the lift-up sections 138*e*, 138*f* in the container body 138.

The shutter 140 is a tubular member and configured to not only close the nozzle receiving hole 139*a* but also block a communication state of the supply port 139*b* when it occupies the closed position. The shutter 140 is mounted to the main body tubular section 139*c* via a stopper member, and prevented from jumping out of the main body tubular section 139*c* when it occupies the closed position. The shutter 140 is configured to slide into the container body from the closed position as shown in FIG. 19 when the transport nozzle 162 is inserted into the nozzle receiver 139, and to move to the open position as shown in FIG. 20 where it not only opens the nozzle receiving hole 139*a* and the supply port 139*b* but also puts the nozzle receiving hole 139*a* and the supply port 139*b* into the communication state.

That is to say, the shutter 140 functions to open the nozzle receiving hole 139*a* in response to insertion of the transport nozzle 162 into the nozzle receiving hole 139*a*, and to close the nozzle receiving hole 139*a* in response to disengagement of the transport nozzle 162 from the nozzle receiving hole 139*a*.

The toner container 38 such configured is mounted by being slid from the front side to the back side of a main body of an image forming apparatus main body 100, so that the second end side 138*b* of the container body 138 is located in the back side of a toner container storage section 31. This direction shall be a mounting direction.

FIG. 19 is an overall view of a toner supply device 160. The toner supply device 160 has a transport nozzle 162 inserted into each toner container to receive supply of a toner, and a transport path 161 connected to the transport nozzle 162 and a developing device 5 and transporting the toner supplied to the transport nozzle 162 to the developing device 5. The transport nozzle 162 is arranged in the back side of a toner container storage section 31 (the body 100 of the image forming apparatus) so that it is opposed to a shutter 140 of the toner container to be inserted into the toner container storage section 31. A sub hopper 163 for storing the toner to be transported by the transport nozzle 162 is provided between the transport nozzle 162 and the transport path 161, and the toner is supplied to the transport path 161 via the sub hopper 163.

The transport path 161 includes a hose 161A, and a transport screw 161B arranged in the hose 161A and transporting the toner from the sub hopper 163 to the developing device 5 by rotating.

The transport nozzle 162 includes a tubular nozzle section 165 to be inserted into the nozzle receiver 139 of the toner containers 38, a connection path connecting the nozzle section 165 and the sub hopper 163, a transport screw 167 arranged in the nozzle section 165 and transporting the toner supplied from the toner container 38 to the connection path 166, and a seal member.

The nozzle 165 extends in the longitudinal direction of the toner container, and its outer circumference can be inserted into the nozzle receiver 139 from the nozzle receiving hole 139*a*. On the outer circumferential surface on the tip side of the nozzle section 165 is formed a powder receiving inlet 170 which receives a toner from the supply port 139*b* of the toner container 38 and guides it to the transport screw 167. A length of the nozzle section 165 is set so that the powder receiving inlet 170 can be opposed to the supply port 139*b* when the nozzle section is inserted into the nozzle receiver 139. A convex section 165*a* is formed at the tip of the nozzle section 165 so that it enters into a recessed section 140*b* of the shutter 140.

The connection path 166 is formed integrally with a base end of the nozzle section 165 located on the opposite side of the powder receiving inlet 170, and in communication with the nozzle section 165. The powder receiving inlet 170 is such formed that it is located on a top face of the nozzle section 165. The transport screw 167 has a screw section 167*a* formed from the tip side of the nozzle section 165 to the connection path 166, and is rotatably supported by the nozzle section 165.

The powder receiving inlet 170 is formed so that it is opposed to the supply port 139*b* of the nozzle receiver 139, when the nozzle section 165 is inserted into the container body 138 from the nozzle receiving hole 139*a* of the nozzle receiver 139.

A description of the drive device 180 of the toner supply device 160 will be omitted as it is identical to the first embodiment.

With reference to FIG. 19 and FIG. 20, operation of the toner supply device 160 thus configured will be described. While the toner container 38 is transported or stored before being mounted to the toner container storage section 31 shown in FIG. 2, the nozzle receiving hole 139*a* is closed by the shutter 140. That is to say, the toner container is generally a sealed state as communication between the nozzle receiving hole 139*a* and the supply port 139*b* is blocked. From this state, as shown in FIG. 19, with the opening 138*d* side as a tip side, the toner container 38 is moved in a mounting direction and horizontally inserted into the toner container storage section 31. When the insertion proceeds, the convex section 165*a* of the nozzle section 165 is inserted into and engages with the recessed section 140*b* of the shutter 140, and thus the shutter 140 is integrated with the transport nozzle side 162.

When the toner container 38 is further moved to the mounting direction, as shown in FIG. 20, the shutter 140 is pushed into the container body 38 by the nozzle section 165 against an urging force of the coil spring 142. The toner container 38 stops moving when they are totally housed in the toner container storage section 31 and the first end side 138*a* of the container body 138 is rotatably held by a support, and occupies a mounted position. The shutter 140 is further slid into the container body by the nozzle section 165 until the toner container 38 occupies the mounted position. By the toner container 38 occupying the mounted position, the shutter 140 stops sliding and occupies an open position. Then, not only the nozzle receiver 139*a* but also the supply port 139*b* are opened, and as shown in FIG. 10, the powder receiving inlet 170 is formed in the nozzle receiver 139 and opposed to the supply port 139*b* located above, and thus communicates with the inside of the toner container.

With the toner container 38 such configured, as the toner container 38 has the nozzle receiver 139 arranged on the second end side 138*b* of the container body 138 and having a supply port 139*b* configured to allow the nozzle section 165 of the transport nozzle 162 having the powder receiving inlet 170 to be inserted therein and to supply the toner in the container body 138 to the powder receiving inlet 170, and the shutter 140 supported by the nozzle receiver 139 to be able to open and close the nozzle receiving hole 139*a* and sliding in response to insertion of the nozzle section 165 of the transport nozzle 162 into the nozzle receiving hole 139*a* of the nozzle receiver 139 to open at least the nozzle receiving hole 139*a* and the supply port 139*b* connected to the nozzle receiving hole 139*a* in the embodiment, and to close the nozzle receiving hole 139*a* in response to disengagement of the nozzle section 165 from the nozzle receiving hole 139*a*, the nozzle receiving hole 139*a* and the supply port 139*b* are kept in a closed state until the nozzle section 165 is inserted into the nozzle receiving hole 139*a* of the nozzle receiver 139. Thus, when the nozzle section 165 of the transport nozzle 162 is disengaged from the nozzle receiving hole 139*a* to replace the toner container 38, any spilling or flying of the powder can be prevented as the nozzle receiving hole 139*a* and the supply port 139 are kept in the closed state by the shutter 140.

When the container body 138 rotates, not only the toner contained in the container body 138 is transported to the second end side 138*b* by action of a helical groove 138*c* but also the transported toner T is mixed with a toner T accumulated in the lower part of the second end side 138*b*.

Figure 21A:
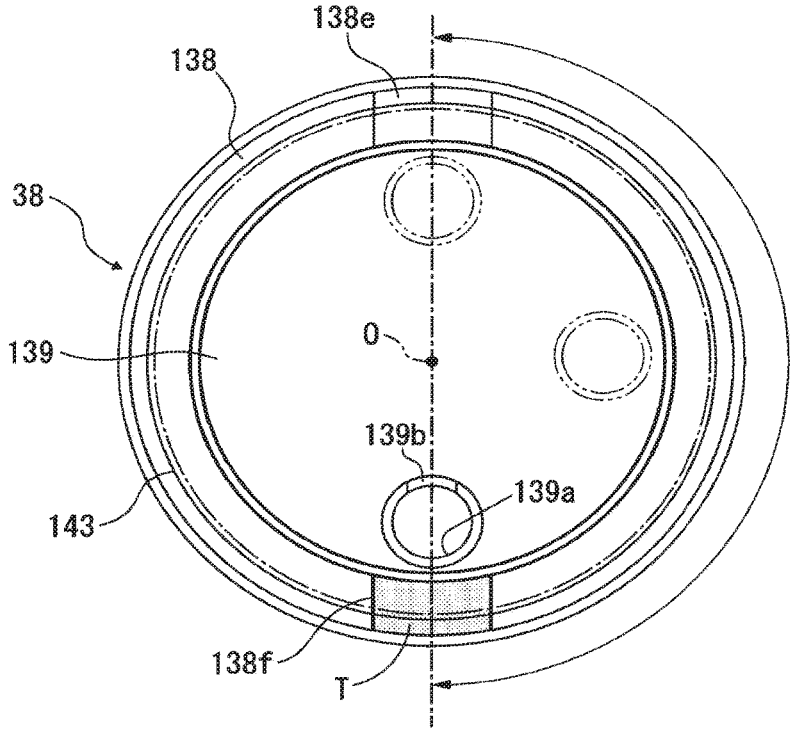
FIG. 21A is a view showing a positional relationship of a supply port, a powder receiving inlet, and a lift-up section when the powder container is rotated.
Figure 21B:
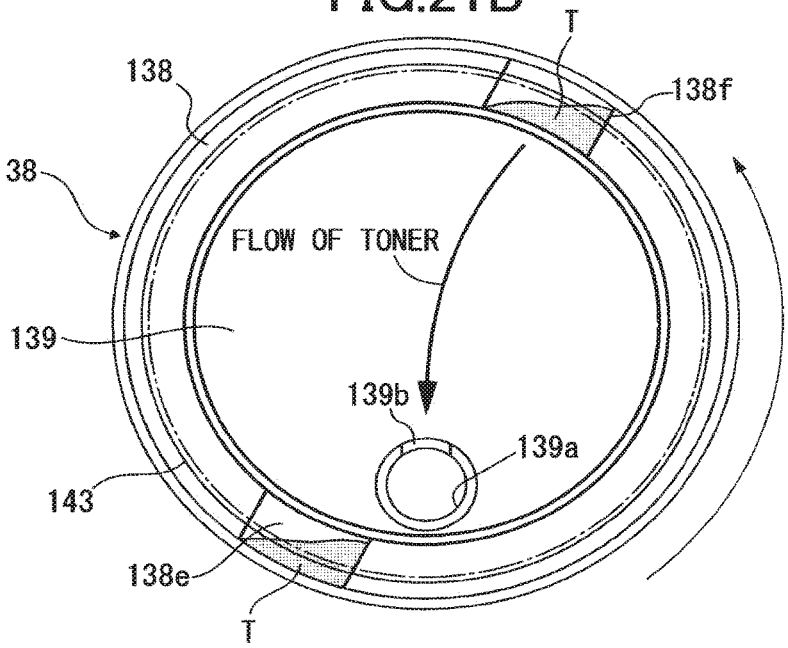
FIG. 21B is a view showing that a toner is supplied to the supply port and the powder receiving inlet when the powder container is rotated.

As shown in FIG. 21A, when the toner container 38 rotates, due to the rotation, the toner T accumulated in the lower part of the container is lifted up in the container alternately by the lift-up section 138*e*, 138*f*, during which, as shown in FIG. 21B, the toner T drops and is supplied into the nozzle section 165 via the supply port 139*b* and the powder receiving inlet 170. That is to say, in the case of this toner container 38, the toner T in the container body 138 is supplied into the nozzle section 165 every time the lift-up sections 138*e*, 138*f* pass over the powder receiving inlet 170 of the nozzle section 165 and the supply port 139*b* provided in the nozzle receiver 139, positions of which match, in one turn of the container.

As shown in FIG. 20, the toner T supplied into the nozzle section 165 is transported by the transport screw 167 toward the connection path 166, and drops on the connection path 166. The dropped toner T is fed into the transport path 161 via the sub hopper 163 shown in FIG. 19, and transported and supplied to the developing device 5 by rotation action of the transport screw 161B.

In the embodiment, as the nozzle receiving hole 139*a* is arranged inside the outer circumference of the container body 138, and the center of the nozzle receiving hole 139*a* O1 is offset from the center of rotation O of the container body 138, the transport nozzle can be freely arranged. Thus, such free layout of the transport nozzle 162 enables downsizing and cost reduction of the device main body. In addition, if a central part O1 of the nozzle receiving hole 139*a* is offset from the center of rotation O of the container body, the supply port 139*b* can efficiently collect any toner dropping from the inner wall of the contain main body 138 because the nozzle receiving hole 139*a* is located closer to the vicinity of the inner wall of the contain main body than when the it is arranged at the center of rotation O of the container body 138.

As the device main body can be downsized, the container body 138 may be more easily made larger. Thus, as volume of filled toner can be increased, a replacement cycle of the toner container 38 can be extended.

As the supply port 139*b* is provided in the nozzle receiver 139 so that it is opposed to the lift-up sections 138*e*, 138*f* in the container body 138, the supply port 139*b* can efficiently collect the toner T which is stirred up by the lift-up sections 138*e*, 138*f* and drops due to its weight.

On the one hand, when the toner container 38 is disengaged from the toner container storage section 31, the toner container 38 is moved to the front side from the mounted position as shown in FIG. 20. Then, with the movement of the toner container 38, the transport nozzle 162 comes off from the container body 138, and the shutter 140 is pushed back by the urging force of the coil spring 142 from the open position to the closed position. Consequently, the supply port 139*b* and the nozzle receiving hole 139*a* are closed by the shutter 140.

Figure 25A:
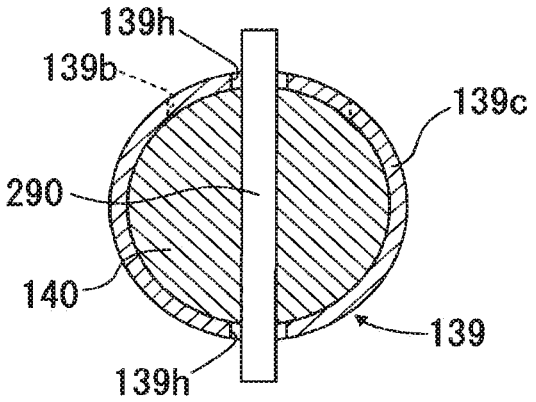
FIG. 25A is a partial cross sectional view showing a configuration of a powder supply device having a loosening member.

As shown in FIG. 25A, in the embodiment, a loosening member 290 for breaking down a toner accumulated near the supply port 139*b* is provided in the shutter 140 described above. As shown in FIG. 25A, the loosening member 290 is configured by a pin protruding outward from the outer circumferential surface of the shutter 140, further penetrating a hole 139*h* formed in the main body tubular section 139*c* of the nozzle receiver 139, and protruding into the container body 138. That is to say, the loosening member 290 is a member protruding to the inside of the container body 138 from the nozzle receiver 139 and configured to be able to move in a moving direction of the shutter 140 in conjunction with an opening and closing operation of the shutter 140.

The loosening member 290 occupies a first position where it occupies the second end side 138*b* of the container body 138 rather than the end of the supply port 139*b* when the shutter 140 occupies the closed position. It occupies a second position where it occupies the first end side 138*a* of the container body 138 rather than the supply port 139*b* when the shutter occupies the open position of the container body 138. Specifically, the loosening member 290 moves to the first position and the second position as the shutter 140 moves.

Figure 26:
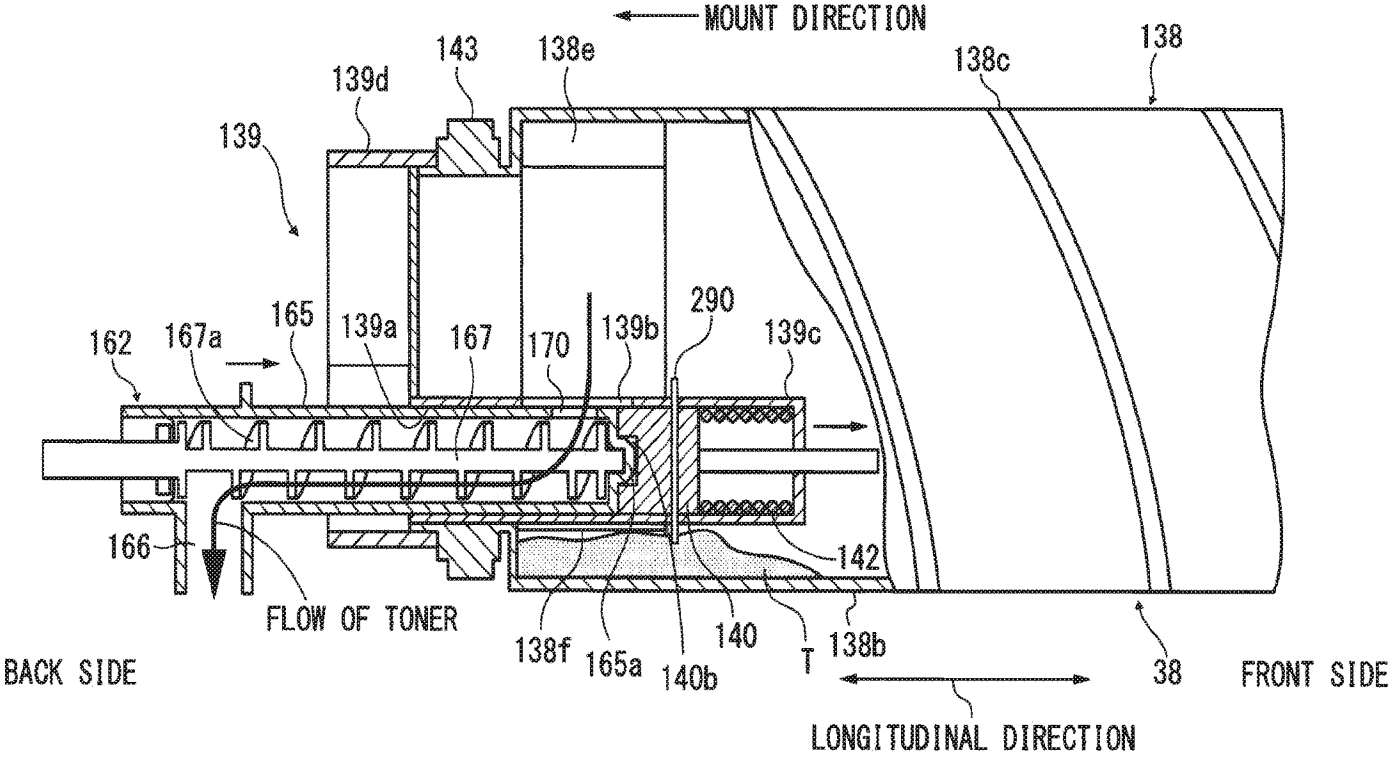
FIG. 26 is a cross sectional view showing that a transport nozzle that a powder supply device includes is attached to a powder container having a loosening member.

With the configuration including such a loosening member 290, as shown in FIG. 26, when the shutter 140 slides, the loosening member 290 also moves. This makes it easier to securely acquire a space around the supply port 139*b*. Thus, a toner can be reliably discharged to the outside of the container while the toner contained in the toner container 38 is prevented from spilling or flying out of the container. Although the loosening member is configured by one pin here, it may be such configured that multiple pins protrude from the main body tubular section 138*c*. The protrusion of the pin does not have to be a fixed amount, and long and short pins may be alternately provided to form a concavo-convex shape.

Figure 25B:
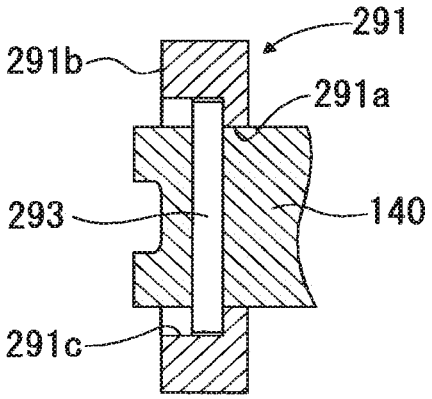
FIG. 25B is a lateral cross sectional view of FIG. 25A.

A loosening member shall not be limited to a pin, and may be a ring member 19 having a through-hole 291*a* formed at the center, as shown in FIG. 25B, for example. In this case, the main body tubular section 139*c* is inserted into the through-hole 291*a* of the ring member 219 and slidably supported by the main body tubular section 139*c*. In addition, by forming a groove section 291*c* on one lateral face 291 of the ring member 291 to fit into a pin 293 penetrating the shutter 140, and fitting the pin 293 into the groove section 291, the pin 293 can move integrally with the shutter 140 and break down the toner T accumulated near the supply port 139*b* through the movement of the shutter 140.

In each embodiment, although the central part O1 of the nozzle receiving hole 139*a* is arranged at the lowest position on the upstream side of the rotation direction of the container body 138, with respect to the center of rotation O of the toner container 38 (container body 138), arrangement of the nozzle receiving hole 139*a* is not limited to this position, and as shown in FIG. 21A, may be arranged between the lowest position and the highest position on the upstream side of the rotation direction of the container body 138, specifically, on the mounting section 139*d* located in the range from the center of the lift-up section 183*e* to the center of the lift-up section 138*f* when the lift-up section 138*e* is positioned above.

Such an arrangement of the nozzle receiving hole 139*a* enables efficient collection of the toner stirred up by the lift-up section 138*e* or 138*f* as a result of rotation of the container body 138.

In each mode described above, the toner container 38 is a recessed helical groove 138*c* formed in the container body 138, and configured to transport a toner in the container body 138 from the first end side 138*a* of the container to the second end side 138*b* into which the nozzle section 165 of the transport nozzle 162 is inserted. However, a powder container to which the present invention applies shall not be limited to this configuration. For example, a well-known agitator for transporting toner by rotating in the container body 138 may be arranged as an additional member in the container body 138. Or, in place of the above-mentioned helical groove 138*c* whose outer side is concave and whose inner side is convex, a helical convex section having a convex inner side and without making the outer side concave may be provided in the container body 138 to transport the toner.

The powder container to be used in the image forming apparatus according to the present invention has a container body for transporting powder contained therein from the first end side to the second end side thereof by self-rotating; a nozzle receiver having a nozzle receiving hole rotatably arranged on the second end side of the contain main body and configured to allow a transport nozzle having a powder receiving inlet to be inserted therein, and a supply port arranged in at least a part of the nozzle receiver and configured to supply the powder in the container body to the powder receiving inlet; and an shutter which is movable in a direction to open and close the nozzle receiving hole, and configured to open the nozzle receiving hole in response to insertion of the transport nozzle into the nozzle receiving hole and to close the nozzle receiving hole in response to disengagement of the transport nozzle from the nozzle receiving hole, wherein the nozzle receiving hole is arranged inside the outer circumference of the container body, and a central part of the nozzle receiving hole is offset from the center of rotation of the container body.

In addition, the nozzle receiver 139 is rotatably supported to the container body 138, and the central part O1 of the nozzle receiving hole 139*a* is offset from the center of rotation O of the toner container 38 (container body 138). In this case, the transport nozzle 162 and the nozzle receiving hole 139*a* may be displaced from each other in a circumferential direction when the toner container 38 is mounted to the toner container 31 (the image forming apparatus main body 100).

Figure 22A:
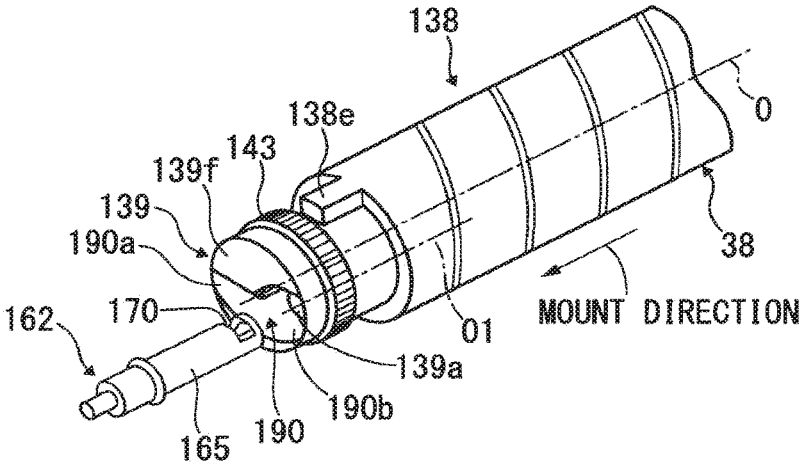
FIG. 22A is a perspective view showing a schematic configuration of a powder container including a nozzle receiver having an inclined surface.
Figure 22B:
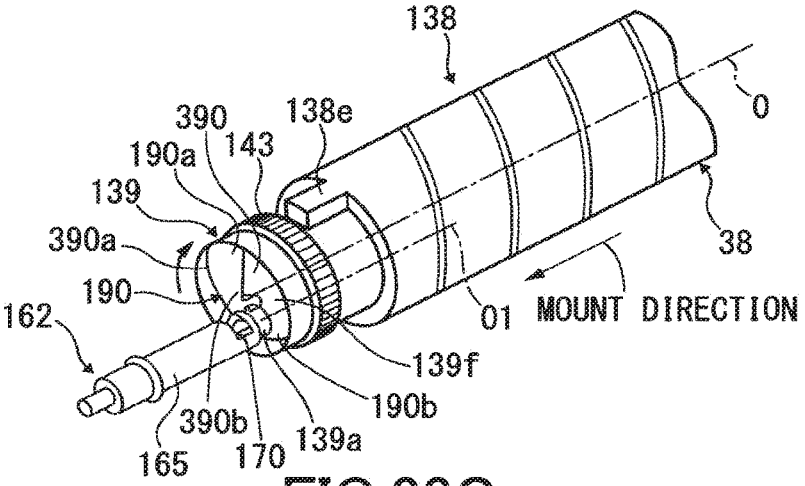
FIG. 22B is a perspective view showing that a transport nozzle matches the nozzle receiving hole when the nozzle receiver is rotated.
Figure 22C:
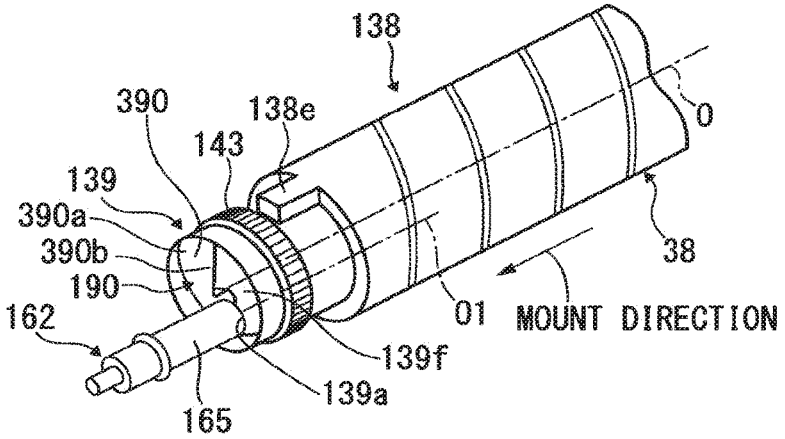
FIG. 22C is a perspective view showing that the transport nozzle enters the nozzle receiving hole from the condition in which the transport nozzle matches the nozzle receiving hole.

To avoid this, in the embodiment, the toner container 38 is provided with a structure to align the nozzle receiving hole 139*a* with the position of the transport nozzle 162. Specifically, as shown in FIG. 22A, an inclined surface 390 inclined from the transport nozzle 162 side toward the inside of the container body 138 is formed on an end face 139*f* of the nozzle receiver 139 opposed to the nozzle section 165 of the transport nozzle 162, and the nozzle receiving hole 139*a* is arranged in the deepest section 390*b* in the inclined surface 390 toward the container body 138. The inclined surface 390 has first end side forming the highest section 390*a* located on the transport nozzle 162 side and the second end side forming the deepest section 390*b*.

Thus, as shown in FIG. 22A, even when the nozzle section 165 and the nozzle receiving hole 139*a* are displaced from each other in the circumferential direction, the tip of the nozzle section 165 contacts the inclined surface 390 with the toner container 38 moved in the mount direction. If the toner container 38 is further moved in the mount direction, the nozzle receiving hole 139 rotates by being pushed by the nozzle section 165. Thus, the tip of the nozzle section 165 moves along the inclined surface 390 of the nozzle receiver 139 and the deepest section 390*b* is opposed to the nozzle section 165. Specifically, in conjunction with the movement of the toner container 38 in the mount direction, the nozzle receiving hole 139*a* rotates and moves to the position which matches the position of the tip of the transport nozzle 162. Thus, the toner container 38 can be mounted to the toner container storage section 31 (the imaging device main body 100) without caring about the orientation thereof, and thereby the toner container 38 can be set more easily.

In the embodiment, the inclined surface 390 is formed in the nozzle receiver 139, and the nozzle receiver 139 is rotated with the inclined surface 390 being in contact with the nozzle section 165 to automatically align the nozzle receiving hole 139*a* with the nozzle section 165. However, the method of changing the position of the nozzle receiving hole 139*a* is not limited to this. For example, a convex section may be provided to the nozzle receiver 139 to be attached to the container body 138 and a recessed section which has a wider receiving port and gradually narrows inside may be provided to the body 100 of the image forming apparatus. Then, the nozzle section 165 and the nozzle receiving hole 139*a* can be set in the proper positions by using these convex and recessed sections. In addition, in the case where the nozzle section 165 is arranged opposed to the lowest position in the end face 139*f* of the nozzle receiver 139, the nozzle receiver 139 may be configured to have its own center of gravity at the nozzle receiving hole 139*a*, and the nozzle receiving hole 139*a* of the nozzle receiver 139 can be always set in the lowest position by utilizing the weight (gravity) of the nozzle receiving hole 139*a*.

Figure 23:
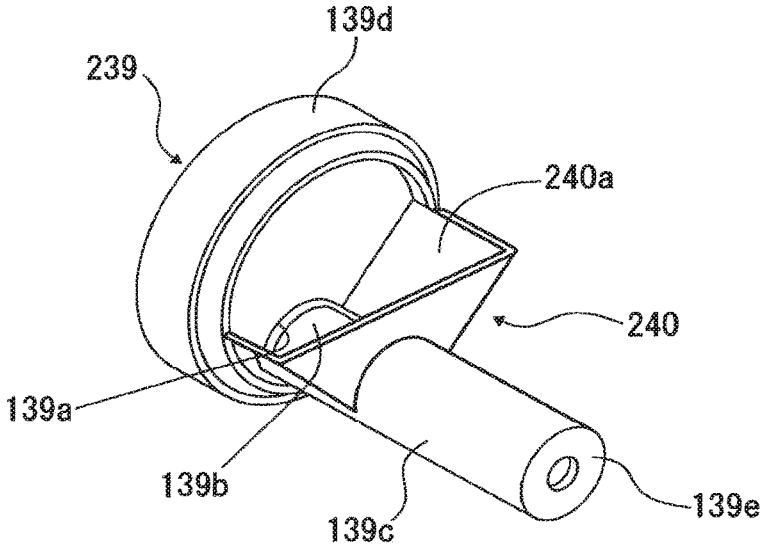
FIG. 23 is a perspective view showing a configuration of a nozzle receiver having a powder retaining section.

Furthermore, as shown in FIG. 23, in the embodiment, a mini hopper 240 communicating with the supply port 139*b* and serving as a powder storage section for collecting the toner in the container body 138 is provided in the nozzle receiver and rotatably mounted to the container body 138. A numeral 239 is assigned to the nozzle receiver according to the embodiment.

A configuration of the nozzle receiver 239 is same as the nozzle receiver 139, except for the mini hopper 240. As shown in FIG. 23, the mini hopper 240 has a box shape formed like a fan protruding from the tubular main body 139*c*, with the lower part of the mini hopper in communication with the supply port 139*b* and the upper part being an opening 240*a* wider than opening area of the supply port 139*b*.

Figure 24:
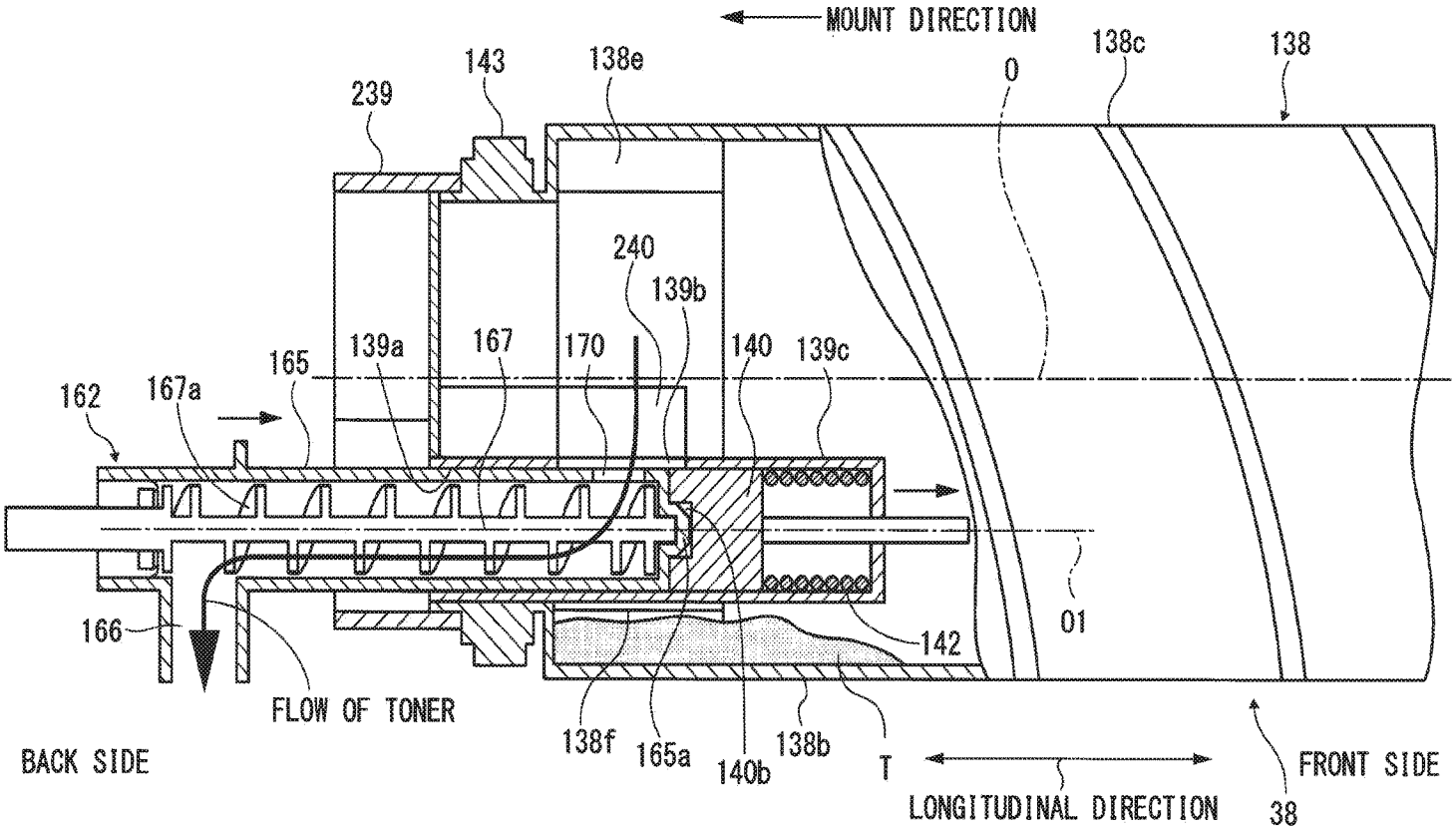
FIG. 24 is a cross sectional view showing that a transport nozzle that a powder supply device includes is attached to a powder container including a nozzle receiver having a powder retaining section.

As shown in FIG. 24, the mini hopper 240 is formed at a position opposed to the lift-up sections 138*e*, 138*f* in the container body 138*b* when the nozzle receiver 239 is mounted to the container body 138.

When the toner container 138 having the nozzle receiver such configured is pushed into the mount position as shown in FIG. 24, the nozzle section 16 is inserted into the nozzle receiving hole 139*a* of the nozzle receiver 239, the shutter 140 moves to the open position, and the supply port 139*b* is in communication with the powder receiving inlet 170.

As such, if the container body 138 includes the nozzle receiver 239, an area for receiving the toner stirred up by the lift-up sections 138*e*, 138*f* and dropping by its own weight when the container body 138 rotates increases, thereby being able to collect the toner more efficiently and store the collected toner in the mini hopper 240. Consequently, the amount of toner to be transported by the transport screw 167 from the supply port 139*b* via the powder receiving inlet 170 can be stabilized.

As described above, the powder supply device according to the second embodiment has a powder container, a transport nozzle inserted into the powder container, and configured to have a powder receiving inlet to which powdery toner is supplied from a supply port of the powder container, and a transport path connected to the transport nozzle and a developing device and configured to transport the toner supplied to the transport nozzle to the developing device, wherein the above-mentioned nozzle receiver is rotatably supported to the container body as a powder container, a central part of the nozzle receiving hole is offset from the center of rotation of the container body, and the supply port is arranged to be located within the container body.

The image forming apparatus according to the second embodiment includes the above-mentioned powder supply device.

According to the second embodiment, since the nozzle receiving hole is arranged inside the outer circumference of the container body, and the central part of the nozzle receiving hole is offset from the center of rotation of the container body, the transport nozzle can be freely arranged, thus enabling downsizing or cost reduction of the device main body through free layout or freeing of the transport nozzle. In addition, if the central part of the nozzle receiving hole is offset from the center of rotation of the container body, the supply port can efficiently collect any toner dropping from the inner wall of the container body because the nozzle receiving hole is located closer to the vicinity of the inner wall of the contain main body than when the it is arranged at the center of rotation of the container body.

As described above, with the invention according to the first embodiment of this case and the invention according to the second embodiment, as the toner container has a nozzle receiver having a nozzle receiving hole arranged on the second end side of the container body and configured to allow a transport nozzle having a powder receiving inlet to be inserted therein or removed therefrom, and a supply port arranged in at least a part of the nozzle receiver and configured to supply the powder in the container body to the powder receiving inlet; and an shutter being movable in a direction to open and close the nozzle receiving hole and configured to open the nozzle receiving hole in response to insertion of the transport nozzle into the nozzle receiving hole and to close the nozzle receiving hole in response to disengagement of the transport nozzle from the nozzle receiving hole, the toner container can prevent any spilling or flying of the powder when the toner container is replaced, because the nozzle receiving hole is closed by the shutter when the transport nozzle is disengaged from the nozzle receiving hole for replacement.

In the aforementioned embodiments, it should be noted that the powder receiving inlet of the transport nozzle is communicated with the supply port at a position toward the container body over the gear in an axial direction of the container body. In a conventional toner bottle including at one end thereof an opening and a driven gear mounted on the end where the opening is provided. So, it is necessary to attach to and remove the toner bottle from an apparatus, and engage the driven gear with a driving gear provided in the apparatus. Therefore, the bottle is provided with a step that a diameter of the end of the bottle on which the driven gear is disposed must be set to be smaller than that of the other portion of the bottle. This results in the opening having a small diameter. Consequently, in the conventional toner bottle, when a toner is discharged from the bottle through the opening, because the opening has a small diameter, the toner is difficult to be incorporated in the bottle. In the embodiments according to the present invention, because the toner is contained in the container through the transport nozzle, it can be accomplished easily to discharge the toner from the container without requiring any complex procedure.

Although the preferred embodiments of the present invention have been described, it should be understood that the present invention is not limited to these embodiments, various changes and modifications can be made to the embodiments.

REFERENCE SIGNS LIST

5: (Y, M, C, K) Developing devices
38: (A to D) Powder containers
138: Container body
138*a*: First end side
138*b*: Second end side
138*e*, 138*f*: Lift-up sections
139, 239: Nozzle receiver s
139*a*: Nozzle receiving hole
139*b*: Supply port
139*f*: End face of nozzle receiver
140: Shutter (Shutter)
160: Powder supply device (Toner supply device)
161: Transport path
162: Transport nozzle
170: Powder receiving inlet
190(A to D): Loosening members
190*d*: Opening penetrating in the moving direction
195: Multiple vane members
196: Pin
240: Powder storage section
240*a*: Opening of powder storage section
390: Inclined surface
390*b*: Deepest section
T: Powder
O: Center of rotation of container body
O1: Central part of nozzle receiving hole

CITATION LIST

Patent Literature

[Patent Document 1] Japanese Patent Publication No. 3492856

What is claimed is:

1. A powder container to contain powder to be used in an image forming apparatus, the powder container comprising:
- a first end;
- a second end disposed opposite to the first end in a longitudinal direction of the powder container and including an opening;
- a nozzle receiving hole which leads to a nozzle receiving space within the powder container;
- a lift-up section which lifts up toner upwards inside the powder container; and
- a gear disposed between the opening and the lift-up section in the longitudinal direction, wherein
- an inner diameter of the powder container where the gear is disposed is smaller than an inner diameter of the powder container at a center of the powder container which is between the second end and the first end,
- the lift-up section is disposed at a position of the powder container such that the powder from the lift-up section is transferred to the nozzle receiving space when the powder container rotates due to rotation of the gear, and
- the nozzle receiving space is extended to an inside of the gear.

2. The powder container according to claim 1, further comprising:
- a nozzle receiver at the second end and including the nozzle receiving hole; and
- a shutter supported by the nozzle receiver and configured to open and close the nozzle receiving hole by sliding in response to insertion of a nozzle of the image forming apparatus.

3. The powder container according to claim 1, further comprising:
- a nozzle receiver at the second end and including the nozzle receiving hole; and a container body which extends in the longitudinal direction containing the powder therein, wherein the gear is formed integrally with the container body.

4. The powder container according to claim 1, further comprising:

a nozzle receiver at the second end and including the nozzle receiving hole; and a container body which extends in the longitudinal direction containing the powder therein, wherein the nozzle receiver is rotatable together with the container body.

5. The powder container according to claim 1, further comprising:

a nozzle receiver at the second end and including the nozzle receiving hole; and a container body which extends in the longitudinal direction containing the powder therein, wherein the nozzle receiver is rotatably supported by the container body.

6. The powder container according to claim 1, further comprising:

a nozzle receiver at the second end and including the nozzle receiving hole;

a supply port disposed in the nozzle receiver to supply the powder, and a loosening member configured to loosen the powder accumulated near the supply port.

7. The powder container according to claim 6, wherein the loosening member protrudes from the nozzle receiver toward the inside of the container.

8. The powder container according to claim 6, further comprising:

a shutter supported by the nozzle receiver and configured to open and close the nozzle receiving hole by sliding in response to insertion of a nozzle of the image forming apparatus, wherein the loosening member is moved in a moving direction of the shutter in conjunction with opening and closing operations of the shutter.

9. The powder container according to claim 8, wherein the loosening member includes a ring that moves on a surface of the nozzle receiver, disposed to be movable together with the shutter, and protrudes from the surface of the nozzle receiver towards the inside of the container.

10. The powder container according to claim 9, wherein the ring has an opening with penetrates there through in moving direction thereof.

11. The powder container according to claim 8, wherein the loosening member includes multiple vanes that move on a surface of the nozzle receiver, disposed to be movable together with the shutter, and protrudes from the surface of the nozzle receiver towards the inside of the container.

12. The powder container according to claim 8, wherein the loosening member includes a pin disposed to be movable together with the shutter, and protrudes from a surface of the nozzle receiver towards the inside of the container.

13. The powder container according to claim 8, wherein the loosening member moves to and from a first position and a second position along with movement of the shutter, the first position located towards a second end side between the supply port and the second end side of the container, the second position located towards a first end side between the supply port and the first end side of the container.

14. The powder container according to claim 6, wherein the loosening member includes a ring that moves on a surface of the nozzle receiver, and protrudes from the surface of the nozzle receiver towards the inside of the container.

15. The powder container according to claim 6, wherein the loosening member includes multiple vanes that move on a surface of the nozzle receiver, and protrudes from the surface of the nozzle receiver towards the inside of the container.

16. The powder container according to claim 6, wherein the loosening member includes a pin protruding from a surface of the nozzle receiver towards the inside of the container.

17. A powder supply device comprising:

a powder container, a transport nozzle inserted into the powder container and including a powder receiving inlet into which a toner as a powder is supplied from a supply port of the powder container, and a transport path connected to the transport nozzle and a developing device and configured to transport the toner supplied to the transport nozzle to the developing device, wherein powder container is the powder container according to claim 1.

18. An image forming apparatus comprising the powder supply device according to claim 17.

19. The powder container according to claim 1, wherein:

the powder container communicates with the powder receiving inlet at a position along the longitudinal direction which is beyond an interior of the gear of the powder container.

* * * * *